US010799036B2

(12) United States Patent
Goltz et al.

(10) Patent No.: US 10,799,036 B2
(45) Date of Patent: Oct. 13, 2020

(54) DISPENSER FOR DISPOSABLE UTENSILS

(71) Applicant: GPCP IP Holdings LLC, Atlanta, GA (US)

(72) Inventors: Ryan A. Goltz, Neenah, WI (US); Roy J. Rozek, Neenah, WI (US); Matthew K. Williquette, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/532,839

(22) Filed: Aug. 6, 2019

(65) Prior Publication Data

US 2020/0093281 A1 Mar. 26, 2020

Related U.S. Application Data

(60) Provisional application No. 62/734,449, filed on Sep. 21, 2018.

(51) Int. Cl.

| | |
|---|---|
| ***A47F 1/10*** | (2006.01) |
| ***A47G 21/02*** | (2006.01) |
| *A47G 21/04* | (2006.01) |

(52) U.S. Cl.

CPC ..... *A47F 1/10* (2013.01); *A47F 2001/103* (2013.01); *A47G 21/02* (2013.01); *A47G 21/04* (2013.01)

(58) Field of Classification Search

None

See application file for complete search history.

(56) References Cited

U.S. PATENT DOCUMENTS

| | | | |
|---|---|---|---|
| 592,105 | A | 12/1899 | Barnes |
| 716,058 | A | 12/1902 | Laing |
| 925,485 | A | 6/1909 | Lafler |
| 999,837 | A | 8/1911 | Morris |

(Continued)

FOREIGN PATENT DOCUMENTS

| | | | |
|---|---|---|---|
| CA | 3020168 | A1 | 10/2017 |
| CA | 3021819 | A1 | 11/2018 |

(Continued)

OTHER PUBLICATIONS

European Search Report for 06009258.2, dated Jul. 24, 2006, five pages, Munich, Germany.

(Continued)

*Primary Examiner* — Gene O Crawford
*Assistant Examiner* — Ayodeji T Ojofeitimi

(57) ABSTRACT

Utensil dispensers and methods for making and using the same. In some examples, the utensil dispensers can include a housing configured to contain a stack of the utensils therein, wherein the stack of the utensils comprises at least one utensil in addition to a next utensil and each utensil comprises at least one contoured projection extending outwardly therefrom. A front pedestal can be disposed inside the housing and can be configured to support the at least one contoured projection extending outwardly from the next utensil. A moveable member can be disposed within the housing and configured to move from a ready position to a dispense position. The moveable member can have at least one extension arm configured with at least one engaging section capable of receiving the contoured projection extending outwardly from the next utensil.

26 Claims, 18 Drawing Sheets

(56) References Cited

U.S. PATENT DOCUMENTS

| | | | |
|---|---|---|---|
| 1,146,447 | A | 7/1915 | Prommel |
| 1,182,793 | A | 5/1916 | Richardson |
| 1,259,927 | A | 3/1918 | Swift |
| 1,355,583 | A | 10/1920 | Zeidler |
| 1,482,071 | A | 1/1924 | Duff |
| 1,504,098 | A | 8/1924 | Cathey |
| 1,546,077 | A | 7/1925 | Hunter |
| 1,547,151 | A | 7/1925 | Watling |
| 1,577,302 | A | 3/1926 | Schultz |
| 1,610,001 | A | 12/1926 | Foster |
| 1,675,510 | A | 7/1928 | Nolan |
| 1,767,634 | A | 6/1930 | Weiss |
| 1,886,378 | A | 11/1932 | Dearsley |
| 2,053,828 | A | 9/1936 | Harper |
| 2,078,984 | A | 5/1937 | Williamson |
| 2,110,189 | A | 3/1938 | Zeidler |
| 2,141,684 | A | 12/1938 | Diemer |
| 2,149,098 | A | 2/1939 | Phinney |
| 2,149,099 | A | 2/1939 | Phinney |
| 2,188,573 | A | 1/1940 | Longo |
| 2,207,528 | A | 7/1940 | Witt |
| 2,239,196 | A | 4/1941 | Lunvik |
| 2,268,596 | A | 1/1942 | Jerum |
| 2,268,873 | A | 1/1942 | Hopkins |
| 2,340,561 | A | 2/1944 | Renfro |
| 2,421,782 | A | 6/1947 | Gibbs |
| 2,427,321 | A | 9/1947 | Casey |
| 2,472,051 | A | 5/1949 | Testi |
| 2,571,668 | A | 10/1951 | Booth |
| 2,577,344 | A | 12/1951 | Masure |
| 2,635,025 | A | 4/1953 | Ziska |
| 2,646,874 | A | 7/1953 | Testi |
| 2,692,691 | A | 10/1954 | Harriss |
| 2,868,344 | A | 1/1959 | Shields |
| 2,877,926 | A | 3/1959 | Abbe |
| 2,880,907 | A | 4/1959 | Mainers |
| 2,911,127 | A | 11/1959 | Driss |
| 2,924,357 | A | 2/1960 | Kingsley |
| 2,954,948 | A | 10/1960 | Johnson |
| 2,965,262 | A | 12/1960 | Bois |
| 3,028,048 | A | 4/1962 | Klammer |
| 3,054,528 | A | 9/1962 | Loomis |
| 3,095,114 | A | 6/1963 | Tobias |
| 3,114,475 | A | 12/1963 | Etes |
| 3,132,765 | A | 5/1964 | Florendo |
| 3,146,908 | A | 9/1964 | Perri |
| 3,163,327 | A | 12/1964 | Maxwell |
| 3,191,802 | A | 6/1965 | Lasting |
| 3,248,156 | A | 4/1966 | Repko |
| 3,300,087 | A | 1/1967 | Kuypers |
| 3,313,452 | A | 4/1967 | Katz |
| 3,371,821 | A | 3/1968 | Abood, Jr. |
| 3,428,215 | A | 2/1969 | Wells |
| 3,558,006 | A | 1/1971 | Redmond |
| 3,587,922 | A | 6/1971 | Oriti |
| 3,680,736 | A | 8/1972 | Viessmann |
| 3,747,803 | A | 7/1973 | Zoepf |
| 3,786,959 | A | 1/1974 | Greb |
| 4,134,519 | A | 1/1979 | Barnett |
| 4,271,978 | A | 6/1981 | Cottrell |
| 4,308,974 | A | 1/1982 | Jones |
| 4,489,854 | A | 12/1984 | Wenkman |
| 4,530,445 | A | 7/1985 | Decker |
| 4,742,937 | A | 5/1988 | Blom |
| 4,850,511 | A | 7/1989 | Kral |
| 4,896,792 | A | 1/1990 | Marchand |
| 5,127,546 | A | 7/1992 | Chen |
| 5,191,997 | A | 3/1993 | Squitieri |
| 5,246,138 | A | 9/1993 | Blevins |
| 5,249,705 | A | 10/1993 | Gates |
| 5,263,596 | A | 11/1993 | Williams |
| 5,509,522 | A | 4/1996 | Laidlaw |
| 5,586,685 | A | 12/1996 | Dorner |
| 5,706,977 | A | 1/1998 | Ogura |
| 5,899,356 | A | 5/1999 | Huisman |
| 5,921,408 | A | 7/1999 | Groenewold |
| 6,250,498 | B1 | 6/2001 | Lovejoy |
| 6,336,568 | B1 | 1/2002 | Tucker |
| D461,663 | S | 8/2002 | Tucker |
| D477,941 | S | 8/2003 | Tucker |
| 6,651,841 | B2 | 11/2003 | Tsuchida |
| 6,837,028 | B1 | 1/2005 | Miano |
| 6,945,427 | B2 | 9/2005 | Hieb |
| 6,976,348 | B1 | 12/2005 | Miano |
| 7,076,932 | B2 | 7/2006 | Rubin |
| 7,210,279 | B1 | 5/2007 | Ahmed |
| 7,322,172 | B2 | 1/2008 | Hoffman |
| 7,412,808 | B2 | 8/2008 | Lavi |
| D584,084 | S | 1/2009 | Tucker |
| 7,513,089 | B2 | 4/2009 | Rubin |
| 7,520,247 | B2 | 4/2009 | Rutledge |
| D607,245 | S | 1/2010 | Tucker |
| 8,070,013 | B2 | 12/2011 | Reinsel |
| 8,297,473 | B2 | 10/2012 | Smith |
| 8,360,273 | B2 | 1/2013 | Reinsel |
| 9,113,729 | B2 | 8/2015 | Talini |
| 9,226,598 | B1 | 1/2016 | Knope |
| 9,700,153 | B2 | 7/2017 | Snyder |
| 10,051,976 | B2 | 8/2018 | Smith |
| 2002/0112445 | A1 | 8/2002 | Scaduto |
| 2004/0089670 | A1 | 5/2004 | Goeking |
| 2005/0082307 | A1 | 4/2005 | Tucker |
| 2007/0108141 | A1 | 5/2007 | Smith |
| 2007/0131705 | A1 | 6/2007 | Behravesh |
| 2007/0193968 | A1 | 8/2007 | Smith |
| 2008/0072432 | A1 | 3/2008 | Teys |
| 2008/0121650 | A1 | 5/2008 | Smith |
| 2008/0128445 | A1 | 6/2008 | Huang |
| 2010/0084418 | A1 | 4/2010 | Reinsel |
| 2010/0170915 | A1 | 7/2010 | Reinsel |
| 2011/0180562 | A1 | 7/2011 | Reinsel |
| 2011/0226797 | A1 | 9/2011 | Reinsel |
| 2012/0080444 | A1 | 4/2012 | Smith |
| 2012/0145734 | A1 | 6/2012 | Walters |
| 2012/0145735 | A1 | 6/2012 | Erickson |
| 2012/0145736 | A1 | 6/2012 | Walters |
| 2013/0032609 | A1 | 2/2013 | Righetti |
| 2013/0193157 | A1* | 8/2013 | Jongen ..... A63F 13/12 221/23 |
| 2014/0117036 | A1 | 5/2014 | Smith |
| 2015/0001235 | A9 | 1/2015 | Smith |
| 2015/0041484 | A1 | 2/2015 | Oakes |
| 2015/0289679 | A1 | 10/2015 | Oakes |
| 2017/0354270 | A1 | 12/2017 | Oakes |
| 2019/0075940 | A1 | 3/2019 | Pierson |
| 2019/0223622 | A1 | 7/2019 | Kennedy |
| 2019/0223623 | A1 | 7/2019 | Kinsley |
| 2019/0223624 | A1 | 7/2019 | Schoening |
| 2019/0223625 | A1 | 7/2019 | Kennedy |
| 2019/0223626 | A1 | 7/2019 | Patterson |

FOREIGN PATENT DOCUMENTS

| | | | |
|---|---|---|---|
| CN | 2865478 | Y | 2/2007 |
| CN | 103919421 | A | 7/2014 |
| CN | 203828595 | U | 9/2014 |
| CN | 103919422 | B | 7/2015 |
| CN | 103960919 | B | 2/2017 |
| EP | 1864596 | A2 | 12/2007 |
| FR | 2889507 | A1 | 2/2007 |
| IT | BS20110157 | A1 | 5/2013 |
| KR | 10-0954569 | | 4/2010 |
| PL | 200112 | B1 | 12/2008 |
| TW | M287639 | U | 2/2006 |
| TW | M293720 | U | 7/2006 |
| WO | 0105280 | A1 | 1/2001 |
| WO | 2004028309 | A1 | 4/2004 |
| WO | 2016155644 | A1 | 10/2016 |
| WO | 2017139525 | A1 | 8/2017 |

(56) References Cited

FOREIGN PATENT DOCUMENTS

| | | | |
|---|---|---|---|
| WO | WO2017139527 | A1 | 8/2017 |
| WO | 2018006062 | A1 | 1/2018 |

OTHER PUBLICATIONS

European Search Report for EP 08014387.8, dated Nov. 11, 2008, four pages, European Patent Office, Munich, Germany.
International Search Report and Written Opinion for PCT/US07/83752, dated Mar. 11, 2008, ten pages, European Patent Office, Munich, Germany.
International Search Report and Written Opinion for PCT/US2009/059915, dated Feb. 3, 2010, 13 pages, European Patent Office, Munich, Germany.
International Search Report and Written Opinion for PCT/US2010/000051, dated Aug. 16, 2010, 6 pages.
International Search Report and Written Opinion for PCT/US2011/058329 dated Feb. 29, 2012.
International Search Report and Written Opinion for PCT/US2011/058767 dated Feb. 29, 2012.
International Search Report and Written Opinion for PCT/US2014/050166, dated Nov. 20, 2014, 11 pages, Korean Intellectual Property Office, South Korea.
International Search Report and Written Opinion for PCT/US2014/050169, dated Jan. 9, 2015, 11 pages, Korean Intellectual Property Office, South Korea.
International Search Report and Written Opinion for PCT/US2014/051639, dated Dec. 9, 2014, 9 pages, Korean Intellectual Property Office, South Korea.
International Search Report and Written Opinion for PCT/US2017/037233, dated Sep. 5, 2017.
International Search Report and Written Opinion for PCT/US2013/022455 dated May 30, 2013.
Written Opinion of the International Searching Authority for PCT/US2007/083922 dated Nov. 17, 2008.
International Search Report and Written Opinion mailed in Application No. PCT/US2019/045218 dated Oct. 30, 2019.

* cited by examiner

DISPENSER FOR DISPOSABLE UTENSILS

BACKGROUND

Field

Embodiments described generally relate to utensil dispensers and methods for making and using same. More particularly, embodiments described relate to utensil dispensers having improved dispense mechanisms, as well as methods for making and using same.

Description of the Related Art

Disposable utensils can typically be found in fast-food and take out restaurants. Conventional utensil dispensers have been used to provide a confined and controlled protective environment for utensils housed within. Such assemblies, however, have challenges and issues delivering utensils to a consumer in a repeatable and reliable manner. Conventional assemblies typically suffer from one or more utensils getting jammed within the dispenser housings and not being able to be dispensed without time consuming attention and disassembly, which exposes the contents inside, i.e. the utensils, to the surrounding environment. Conventional assemblies also have difficulties associated with re-loading utensils and maintaining a reliable supply of utensils for user demand.

There is a need, therefore, for a utensil dispenser that can supply utensils to users in a reliable and sanitary manner.

SUMMARY

Utensil dispensers and methods for making and using the same are provided herein. In some examples, the utensil dispensers can include a housing configured to contain a stack of the utensils therein, wherein the stack of the utensils comprises at least one utensil in addition to a next utensil and each utensil comprises at least one contoured projection extending outwardly therefrom; a front pedestal disposed inside the housing, the front pedestal configured to support the at least one contoured projection extending outwardly from the next utensil; and a moveable member disposed within the housing and configured to move from a ready position to a dispense position, the moveable member comprising at least one extension arm configured with at least one engaging section, wherein the engaging section is capable of receiving the contoured projection extending outwardly from the next utensil.

A utensil dispenser can also include a housing configured to contain a stack of the utensils therein, wherein the stack of the utensils comprises at least one utensil in addition to a next utensil and each utensil comprises at least one contoured projection extending outwardly therefrom; a front pedestal disposed inside the housing, the front pedestal configured to support the at least one contoured projection extending outwardly from the next utensil; a rear pedestal disposed inside the housing, the rear pedestal configured to support a handle end of the next utensil; a dispensing mechanism disposed within the housing, the dispensing mechanism comprising at least two engaging surfaces configured to move back and forth; a moveable member disposed within the housing and configured to move from a ready position to a dispense position due to the back and forth movement of the dispensing mechanism, the moveable member having at least one extension arm extending away from the rear pedestal and configured with at least one engaging section proximate a distal end thereof, wherein the engaging section is capable of receiving at least a portion of the contoured projection extending outwardly from the next utensil.

A utensil dispenser can also include a housing configured to contain a stack of the utensils therein; an access port providing an opening to the housing; a drive mechanism configured to contact and release a utensil from the lowermost position of the stack; and an inclined surface located beneath the stack of utensils, the inclined surface comprising a positioning mechanism formed thereon.

A utensil dispenser can also include a housing configured to contain a stack of the utensils therein; an access port providing an opening to the housing; a drive mechanism configured to contact and release a utensil from the lowermost position of the stack; an inclined surface located beneath the stack of utensils; and an actuator that is operably connected to the drive mechanism, the actuator configured to move the drive mechanism between a ready position and dispense position, wherein the actuator comprises: a body that is pivotably mounted to the housing, an opening formed through a lower portion of the body, and at least one arm located proximate the opening and extending from the body toward the access port.

A utensil dispenser can also include a housing configured to contain a stack of the utensils therein, wherein the stack of the utensils comprises at least one utensil in addition to a next utensil; an access port providing an opening to the housing; a drive mechanism configured to contact the next utensil; an actuator that is operably connected to the drive mechanism and configured to move the drive mechanism where the drive mechanism pushes the next utensil in the stack causing the next utensil to release from the stack of the utensils; and a prime mechanism configured to move the actuator and the drive mechanism between a ready position and a dispense position, the prime mechanism comprising a primer handle mechanically linked to a ratchet having one or more teeth for engaging a pawl that is disposed on an inner wall of the housing.

A utensil dispenser can also include a housing configured to contain a stack of the utensils therein, wherein the stack of the utensils comprises at least one utensil in addition to a next utensil and each utensil comprises at least one contoured projection extending outwardly therefrom; a front pedestal disposed inside the housing, the front pedestal configured to support at least one of the at least one contoured projections extending outwardly from the next utensil; and a moveable member disposed within the housing, the moveable member having an engaging section capable of engaging the contoured projection extending outwardly from the next utensil, the moveable member configured to move from a ready position to a dispense position.

Methods for using and operating a utensil dispenser can include: pulling a handle end of a utensil extending from a housing configured to contain a stack of utensils therein, each utensil comprising at least one contoured projection extending outwardly therefrom and supported on a front pedestal disposed inside the housing; triggering a movement of a first portion of a dispensing mechanism to move an extension member within the housing, the extension member having an engaging section capable of receiving the contoured projection extending outwardly from a utensil located at a bottom of the stack, wherein generally linear movement of the extension member releases the utensil from the bottom of the stack; and retaining the released utensil within the housing using a second portion of the dispensing mechanism, the second portion located beneath the first portion and comprising an opening to allow the handle end of the released utensil to pass through and extend outside the housing.

DETAILED DESCRIPTION

Figure 2:
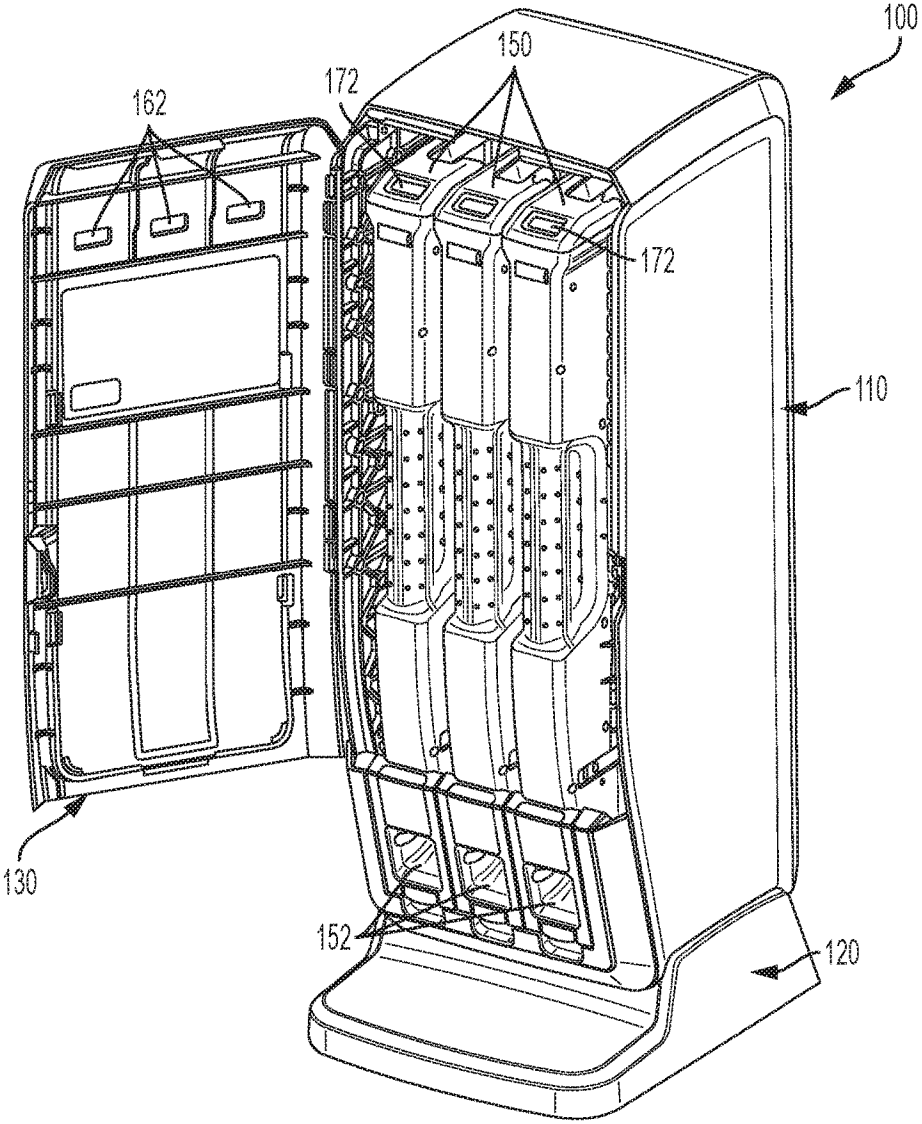
FIG. 2 depicts a perspective view of the illustrative utensil dispenser of FIG. 1 with an access door open to reveal one or more dispense chassis located therein, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure. The figures are not necessarily to scale and certain features and certain views of the figures may be shown exaggerated in scale or in schematic for clarity and/or conciseness Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

Figure 1:
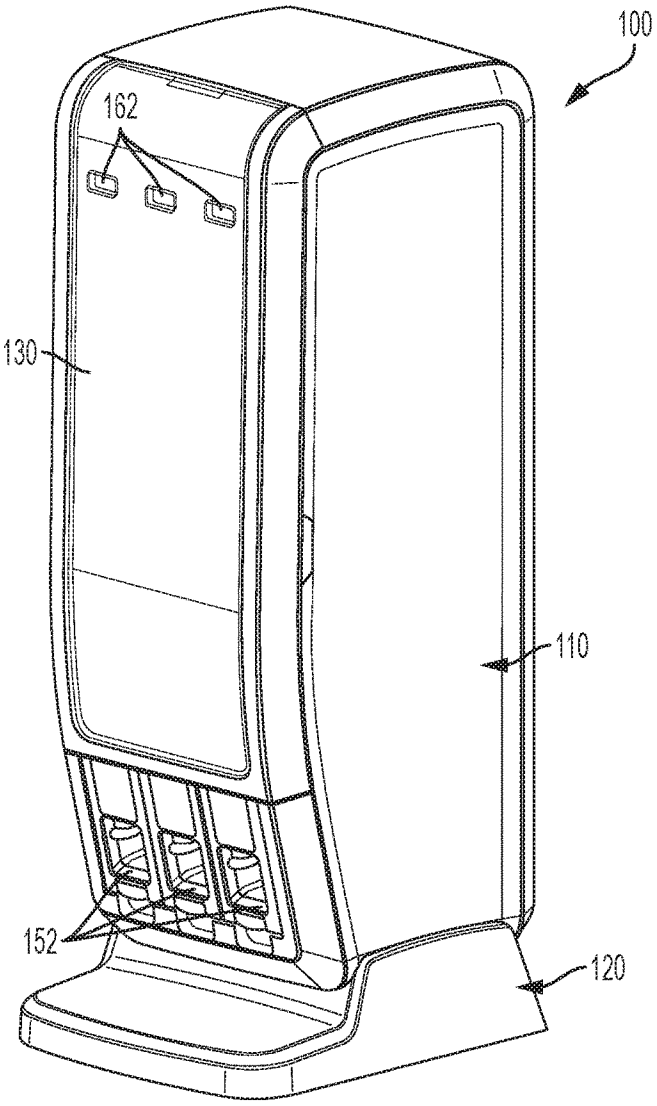
FIG. 1 depicts a perspective view of an illustrative utensil dispenser, according to one or more embodiments provided herein.

FIG. 1 depicts a perspective view of an illustrative utensil dispenser 100, according to one or more embodiments. The utensil dispenser 100 can include a housing or body 110 having a base 120 and an access door 130. The base 120 can provide support for the dispenser housing 110 and allows the utensil dispenser 100 to be free standing. The base 120 can be fixedly attached to the bottom of the dispenser housing 110 using one or more fasteners such as screws, bolts, rivets, or any other type of fastener. The dispenser housing 110 can also sit on the base 120 without any form of mechanical fastening. The base 120 can be removable so that the utensil dispenser 100 can be wall mounted using one more wall mounting attachment holes (not shown in these views).

The access door 130 can swing opened and closed using one or more hinges attached to the dispenser housing 110. The hinge locations can vary and can be located at the top, bottom, or side of the dispenser housing 110. The access door 130 can include one or more fill level apertures or windows 162 that align with corresponding fill level apertures or windows 172 disposed on the dispense chassis 150. As explained further below with reference to FIGS. 22-24, these apertures or windows 162, 172 allow a visual indication of the stock of utensils within the dispenser to be visible outside the dispenser 100.

FIG. 2 depicts a perspective view of the illustrative utensil dispenser of FIG. 1 with the access door 130 opened to reveal one or more dispense chassis 150 located therein, according to one or more embodiments. Within the dispenser housing 110, the utensil dispenser 100 can include one or more dispense chassis 150 for dispensing a plurality of utensils through an access port 152 disposed at one end of each dispense chassis 150. Each dispense chassis 150 can be pre-packaged with utensils (i.e. knife, fork, spoon, spork, etc.). In some implementations, the dispense chassis 150 is replaced with a new dispense chassis 150 and is not reused. In other implementations, the dispense chassis 150 can be refilled and reused in the utensil dispenser 100.

The utensil dispenser 100 can accept one, two, or three or more dispense chassis 150. The utensil dispenser 100 of FIG. 2 is shown with three dispense chassis 150, e.g., one for each of a spoon, fork, and knife, but any combination of utensils can be used. Further, any of the dispense chassis 150 can be located within any dispensing position (e.g. left, right, middle for a 3 chassis dispenser) within the dispenser housing 110. Accordingly, a dispense chassis 150 of any type of utensil can be placed into any available position.

Figure 3:
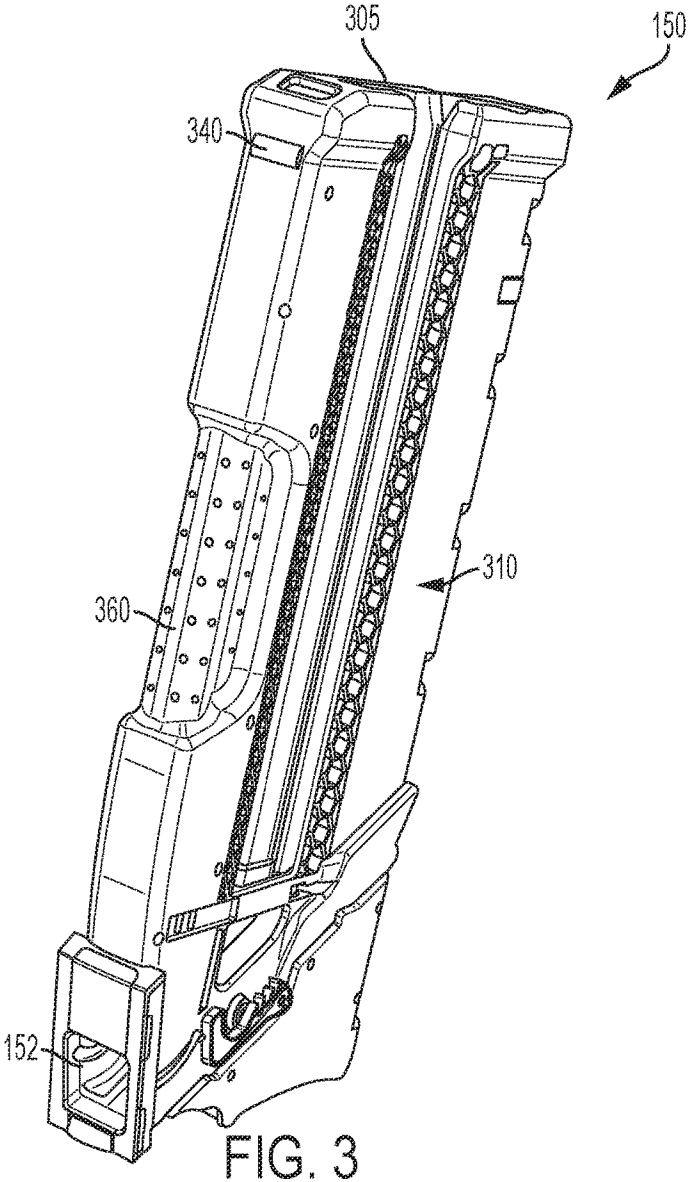
FIG. 3 depicts a side elevation view of an illustrative dispense chassis for use with the dispenser, according to one or more embodiments provided herein

FIG. 3 depicts a side elevation view of an illustrative dispense chassis 150 for use with the dispenser, according to one or more embodiments. The dispense chassis 150 can include a top 305 disposed on a first or upper end of a chassis body or chassis housing 310. The chassis housing 310 can further include a griper or handle 360 formed in a centrally located section or portion thereof. The handle 360 can provide a point of engagement for service personnel to more sanitarily carry or transport the dispense chassis 150 without having to touch the top 305 or access port 152 where the utensils will be removed. The handle 360 will also allow a service personnel a point of contact to better manipulate the dispense chassis 150 when loading or loaded in the dispenser 100. Dispense chassis 150 can have one or more corresponding fill level windows 340 that allow a visual indication of the stock of utensils in each respective dispense chassis 150, as explained below. In other embodiments, the fill level windows 340 can allow a line of sight into the chassis interior from the corresponding sight windows 162 on the access door 130 (FIG. 2).

Figure 4:
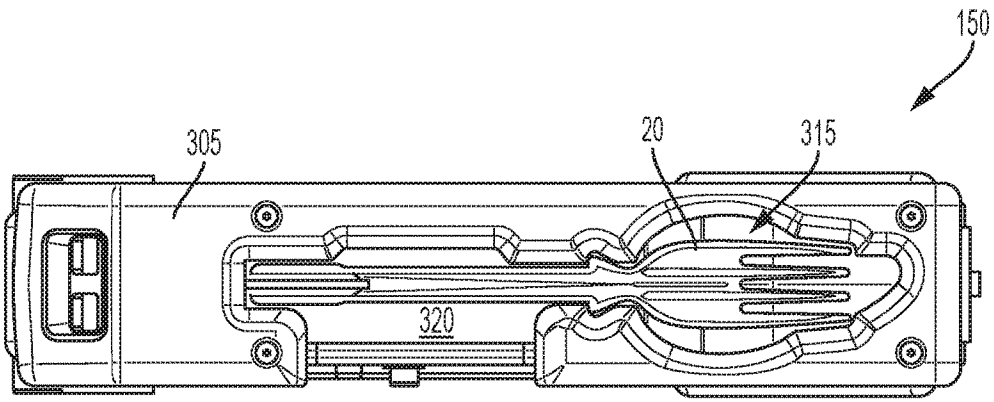
FIG. 4 depicts an illustrative plan view of a dispense chassis, according to one or more embodiments.

FIG. 4 depicts an illustrative plan view of a dispense chassis 150, according to one or more embodiments. As shown, the top 305 of the dispense chassis 150 can include an opening 315 to provide access to a cavity or chamber 320 within the chassis housing 310 for storing utensils therein. The opening 315 can be universally configured or shaped to allow any type of utensil 20 to pass through, including for example, a knife, fork (as shown), spoon and spork. Alternatively, each dispense chassis 150 can have a top opening 315 specific to one type of utensil. In some embodiments, the top 305 can be snap fitted onto the chassis housing 310, so the top 305 can be easily removed or interchanged to customize the utensil types for a particular dispense chassis 150.

Figures 5A, 5B, 5C:
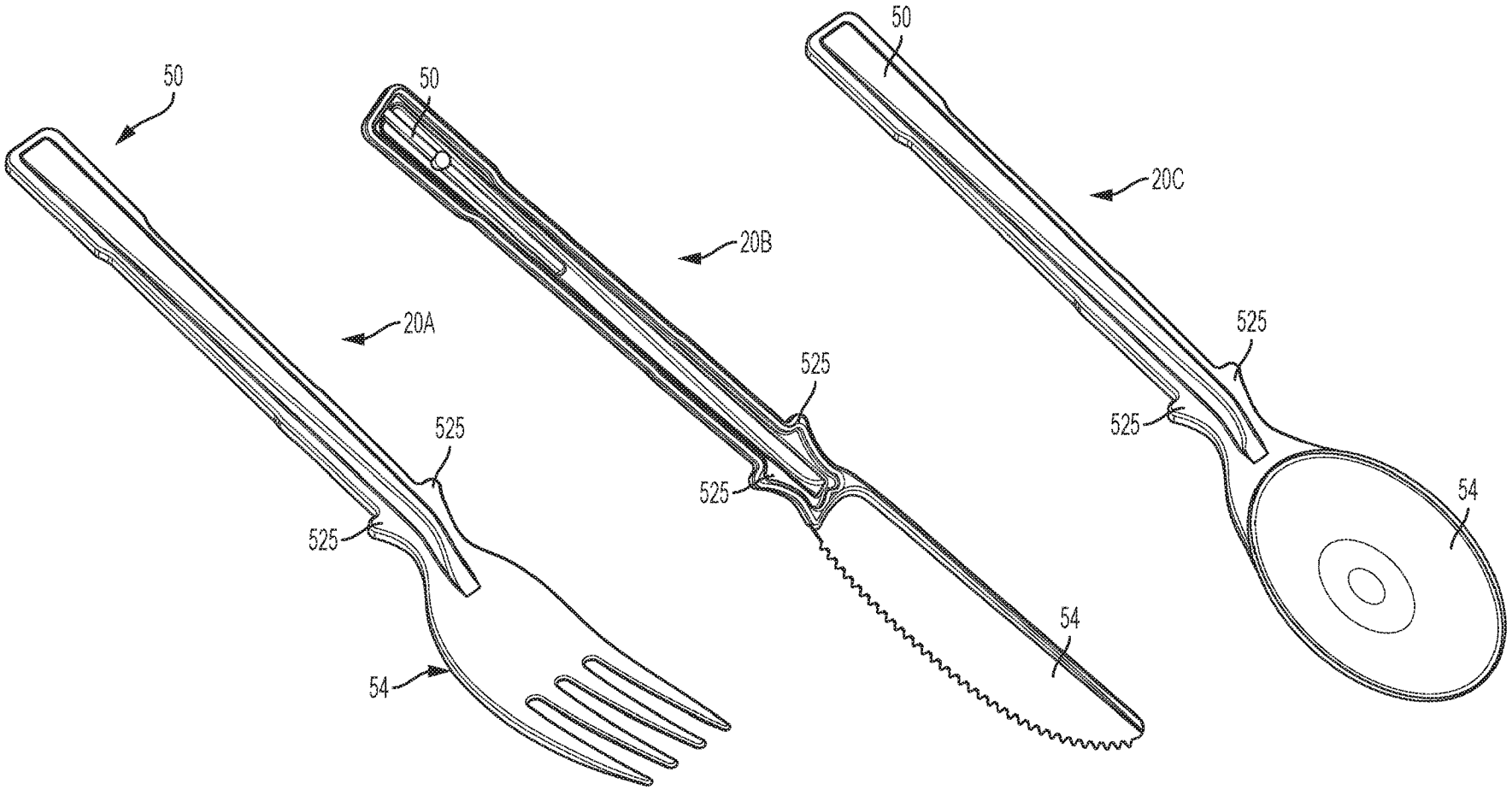
FIG. 5A depicts a perspective view of a fork for use with the utensil dispenser, according to one or more embodiments.
FIG. 5B depicts a perspective view of a knife for use with the utensil dispenser, according to one or more embodiments.
FIG. 5C depicts a perspective view of a spoon for use with the illustrative utensil dispenser, according to one or more embodiments.

FIG. 5A depicts a perspective view of a fork 20A for use with the utensil dispenser, according to one or more embodiments. FIG. 5B depicts a perspective view of a knife 20B for use with the utensil dispenser, according to one or more embodiments. FIG. 5C depicts a perspective view of a spoon 20C for use with the illustrative utensil dispenser, according to one or more embodiments. Each utensil 20A, 20B, 20C can have a functional portion or section 54 adjacent and adjoining a handle 50. The functional section 54 can be configured to perform a function that assists in the consumption of food, such as for example, cutting, piercing, and/or scooping. The handle 50 can be utilized by a user to hold and/or manipulate the utensil 20. Each utensil 20A, 20B, 20C can include one or more contoured projections 525 formed thereon. The contoured projections 525 can include any suitable number, shapes and/or sizes of wings or detents formed on one or both sides of the utensil 20A, 20B, 20C. For example, each contoured projection 525 can have or can include a tapered, squared, rounded or other shaped outer surface. The contoured projections 525 provide a point of engagement for use within the dispense chassis 150, as will be explained in more detail below. Each utensil 20A, 20B, 20C can be disposable and constructed from a formable material. The formable material can include, for example, plastic, combinations of plastics, or combinations of plastics and other materials suitable for use as disposable or reusable cutlery. In certain embodiments, the formable material can be or include polystyrene, polyethylene, polypropylene, as well as blends and mixtures thereof.

Figure 6A:
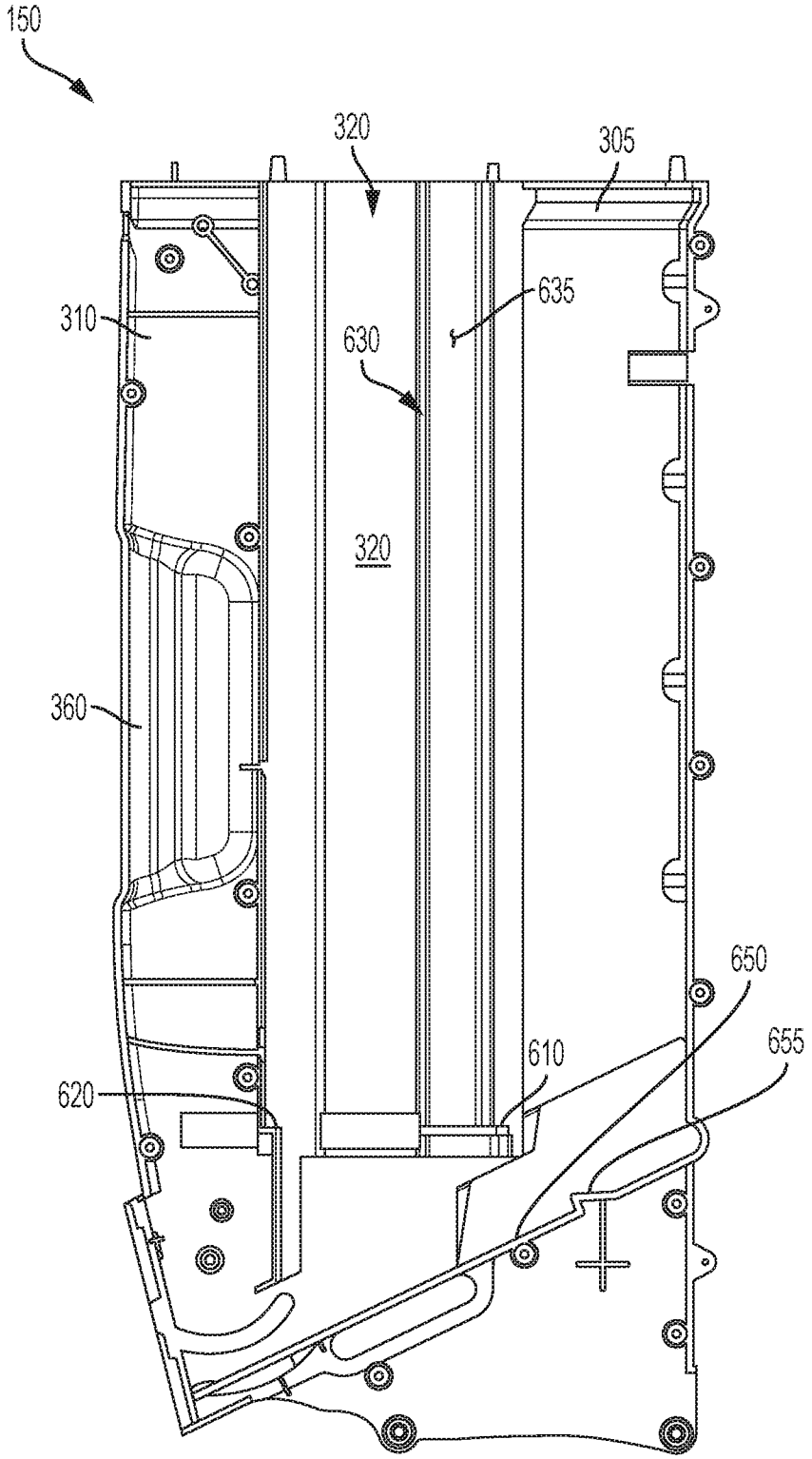
FIG. 6A depicts a cut away side view of the dispense chassis, according to one or more embodiments provided herein. Several components within the dispense chassis have been removed to better illustrate the interior of the chassis body.

FIG. 6A depicts an enlarged cut away side view of the dispense chassis 150, according to one or more embodiments. Several components within the dispense chassis 150 have been removed to better illustrate the interior side of the chassis housing 310. As depicted, the chassis housing 310 can include a front pedestal 610 and a rear pedestal 620 for contacting and supporting utensil 20. At least one generally vertical guide rail 630 can be disposed in or on one or both side walls of the chassis housing 310. The guide rail 630 can be configured for maintaining the utensils 20 in a stacked orientation within the chamber 320 of the dispense chassis 150. The guide rail 630 can extend the entire length of the dispense chassis 150 or any portion thereof, and can have a cross section that is sized and shaped to retain a stack of utensils 20 (not shown). The guide rail 630 can include one more contours or recessed portions 635 that are shaped and/or have a cross section that is complementary to the wings or detents 525 on each utensil 20. The guide rail 630 can also include two spaced apart extensions or protrusions forming a contour or recessed portion 635 therebetween. The recessed portion 635 can be formed in one or both sidewalls of the dispense chassis 150, or the recessed portion 635 can be formed by attaching the spaced apart extensions or protrusions as separate components to one or both sidewalls of the dispense chassis 150. In use, the contoured projections 525 of each utensil 20 resides at least partially within the recess 635 of the guide rail 630.

Figure 6B:
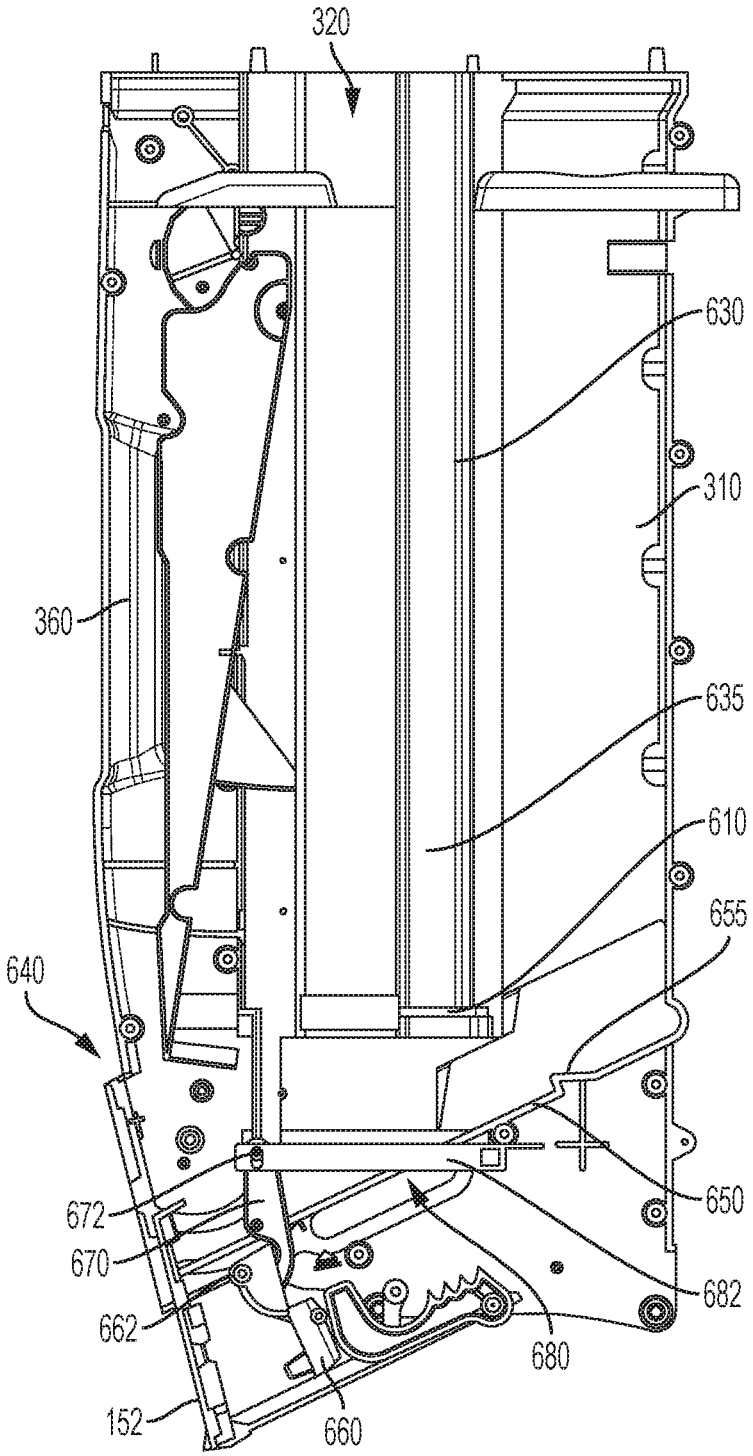
FIG. 6B depicts a cut away side view of the dispense chassis, according to one or more embodiments provided herein.
Figure 7A:
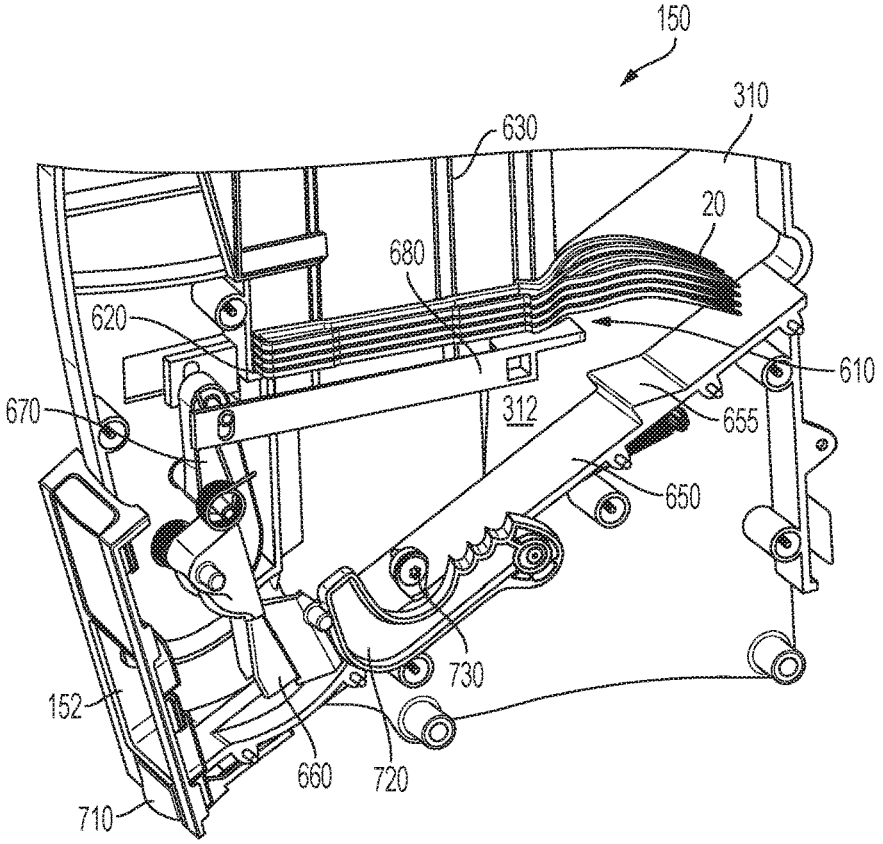
FIG. 7A depicts an enlarged cut away side view of the lower portion of the dispense chassis in a ready to be primed position, according to one or more embodiments provided herein.

Still considering the guide rails 630, FIG. 6B depicts a cut away side view of the dispense chassis 150, according to one or more embodiments. Each guide rail 630 can be vertically aligned above the front pedestal 610. In use, a contoured projection 525 adjacent the functional portion 54 of a bottom utensil fits at least partially within the recess 635, and utensils 20 within the chamber 320 rest on the front pedestal 610, as depicted in FIG. 7A. When there is more than one recess 635 of the guide rail 630 on the same side of the chassis housing 310, there can be additional contoured projections 525 on one or both sides of utensil 20 complementary to the additional recesses 635 and can further guide the utensils 20 into position and help a stack of utensils remain in a stacked orientation within the chamber 320.

Figure 6C:
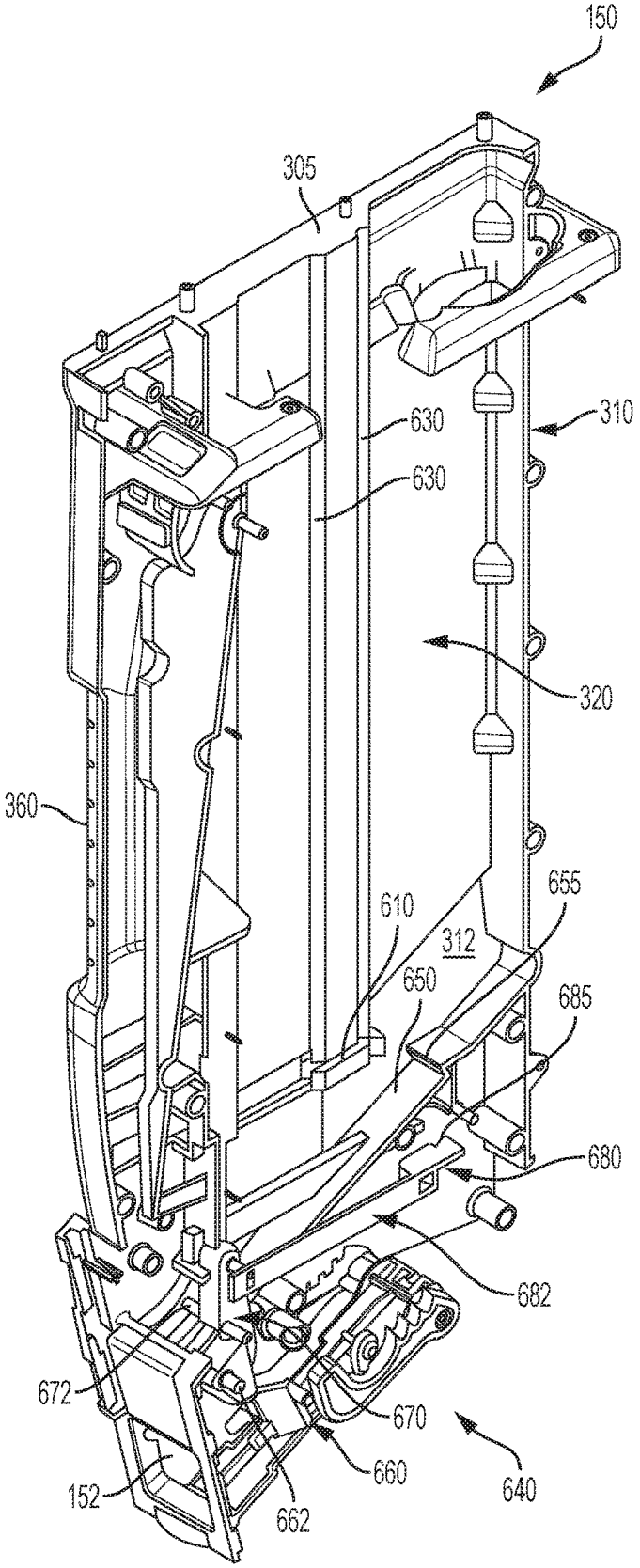
FIG. 6C depicts an isometric view of the dispense chassis having a portion of the housing removed to reveal the dispensing mechanism therein, according to one or more embodiments provided herein.

FIG. 6C depicts an isometric view of the dispense chassis 150 having a portion of the chassis housing 310 removed to reveal a dispensing mechanism 640 therein, according to one or more embodiments. Referring to FIGS. 6B and 6C, the dispensing mechanism 640 can include an actuator 660, drive mechanism 670 and moveable member 680. The actuator 660 can be attached or otherwise supported by the chassis housing 310 and configured to pivot or swing about a pivot point or axis 662.

The actuator 660 can include a shaped or cam surface in communication with the drive mechanism 670, which can also include a contoured or cam surface. The shaped surfaces on the actuator 660 and the drive mechanism 670 can be similar or different. The actuator 660 can further include an opening 665 formed in a lower portion thereof. This opening 665 can be sized to permit passage of the handle portion of each utensil 20, while retaining the larger, functional portion of each utensil 20 as the utensil 20 moves down a gravity ramp 650. In this capacity, the actuator 660 can serve the function of a door or gate that can have opened and closed positions.

The drive mechanism 670 can be affixed to the chassis housing 310 via a pivot point or axis 672. Movement of the actuator 660 translates to the drive mechanism 670, allowing the drive mechanism 670 to move in a first direction and a second direction, e.g. backwards and forwards. A spring 676 can be operatively linked to the drive mechanism 670 to urge the drive mechanism 670 toward its second or ready position after rotation.

The moveable member 680 can be operatively connected to the drive mechanism 670. Movement of the drive mechanism 670 causes movement of the moveable member 680. The moveable member 680 can be any arm, bar, or other extension device that can slide or otherwise move linearly or substantially linearly within the chassis housing 310. The moveable member 680 can be rigid or can have sufficient flexibility to flex or deflect outwardly when contacted by sufficient resistance. The moveable member 680 also can be or can include one or more fingers, bars or extensions 682 that are configured to contact or otherwise engage at least a portion of a utensil 20 resting on the pedestals 610, 620. Each extension 682 can be configured to move at the same time as the others or each extension 682 can move independently of the others.

Each extension 682 can include one or more engaging sections 685 (FIG. 6C) that are sized and shaped to engage the contoured projection 525 of each utensil 20. For example, each engaging section 685 can be or include a key, cut-out, slot, notch, or other opening. The engaging section 685 can also be an area of reduced wall thickness formed along the length of the extension 682. The moveable member 680 through the engagement of the at least one engaging section 685 with the at least one contoured projection 525 on a utensil 20 is configured to advance a utensil 20 by a sufficient distance to release the utensil 20 from the pedestals 610, 620, causing the utensil 20 to fall onto the gravity ramp 650. The engaging section 685 can matingly engage any one or more contoured projection 525 on a utensil 20. The engaging section 685 can also engage an outer surface of the one or more contoured projections 525 on a utensil 20. Although not shown, a reverse configuration can used where a notch or recess can be formed in the side of the utensil and the engaging section 685 of the extension 682 can have a detent or protrusion to fit within the notch or recess. In yet another embodiment not shown, the utensil can include a notch or recess in addition to the contoured projection 525, such notch or recess sized and shaped to at least partially receive a detent or protrusion on the engaging section 685 of the extension 682.

In use, a user or customer will grasp a handle 54 of a utensil 20 and pull the utensil 20 free from the dispenser 100 via the access port 152 of the dispense chassis 150. In response to the movement or removal of the utensil 20 by the user, the dispense chassis 150 can position the handle 54 of another utensil 20 for removal by a user via the access port 152. As one utensil 20 is removed, another utensil 20 can be moved into position until the dispense chassis 150 is emptied of utensils 150. It should be appreciated that the functional ends 54 of the utensils 20 that can come into contact with food, e.g., fork tines, spoon bowls, knife blades, etc., are protected within the dispense chassis 150 and remain within the dispense chassis 150 until ready for use.

Once each dispense chassis 150 has been loaded within the dispenser housing 110, each dispense chassis 150 can be primed or prepared for dispensing. FIG. 7A depicts an enlarged cut away side view of the lower portion of the dispense chassis in a ready to be primed position, according to one or more embodiments. As depicted, the dispense chassis 150 can include a priming assembly 700. The priming assembly 700 can include at least one primer handle 710, primer arm or rachet 720 and pawl 730. The primer handle 710 can be located beneath the access port 152 and can be configured to move in and out of the chassis housing 310. The primer handle 710 can be operatively linked to at least one primer arm or ratchet 720. The ratchet 720 can include a push surface for engaging the actuator 660, a series of teeth or projections for receiving the pawl 730, and a dwell surface located between the teeth and the push surface for resetting the pawl 730. Being operatively linked, the ratchet 720 moves with the primer handle 710. Although not shown, the priming assembly 700 can include one or more return springs affixed to the primer handle 710 and/or the ratchet 720 to return the priming assembly 700 to its resting or closed position. In some embodiments, the primer assembly 700 can include two ratchets 720, position opposite one another on each side of the primer handle 710.

Each pawl 730 can be affixed to a side of the chassis housing 310 and can freely rotate or pivot in both the clockwise and counter-clock wise directions. As the primer handle 710 and ratchet 720 are pulled, the pawl 730 engages the teeth on the ratchet 720, preventing the ratchet 720 and handle 710 from retracting prematurely. The pawl 730 allows a user to extend the primer handle 710, which allows the actuator 660 to pivot or rotate to an open or dispense position. When the primer handle 710 is pulled sufficiently to clear the teeth from the pawl 730, the pawl 730 can disengage from the ratchet 720, allowing the primer handle 710 and the ratchet 720 to return to their resting or closed position. Movement of the ratchet 720 allows the actuator 660 to move toward an opened position, creating sufficient space to allow a released utensil on the ramp 650 to slide through the actuator 660 and exit the dispense chassis 150. If not for the ratchet 720 and pawl 730, a user could repetitiously pull the primer handle 710 to release multiple utensils from the bottom of the stack without fully opening the actuator 660, which would jam the dispense chassis 150 with the multiple released utensils piling on the gravity ramp 650.

Figure 7B:
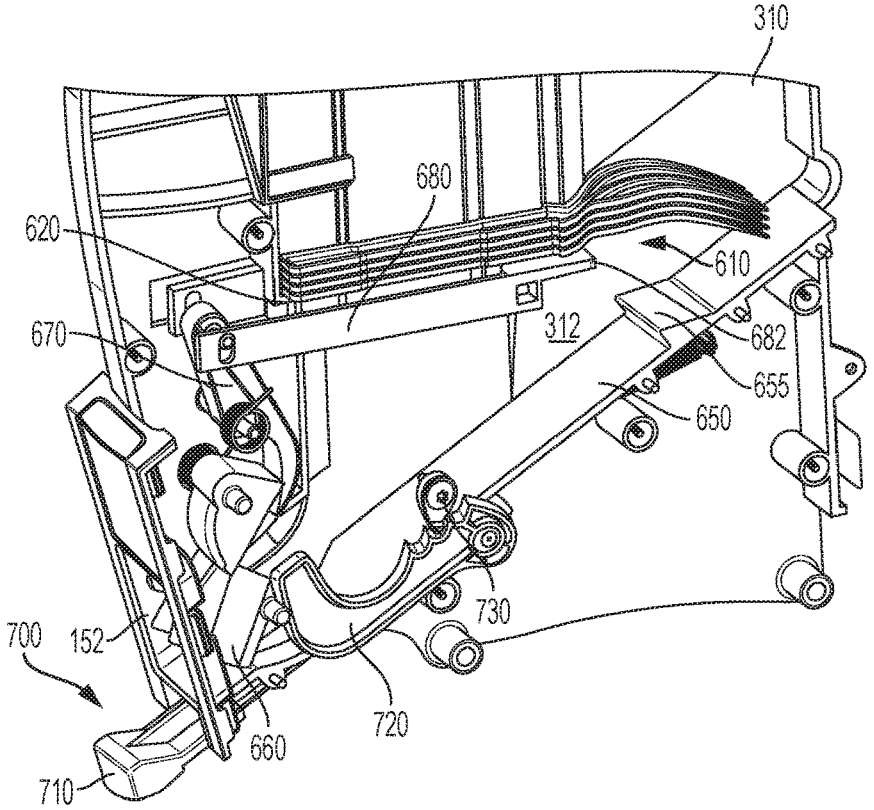
FIG. 7B depicts an enlarged cut away side view of the lower portion of the dispense chassis as the primer handle begins to extend from the dispense chassis, according to one or more embodiments provided herein.

FIG. 7B depicts an enlarged cut away side view of the lower portion of the chassis housing 310 as the primer handle 710 is partially extended, according to one or more embodiments. Referring to FIG. 7B, as the primer handle 710 moves away from the chassis housing 310, the ratchet 720 moves underneath the pawl 730, and the push surface of the ratchet 720 pushes against the actuator 660. The actuator 660 rotates, driving the drive mechanism 670, which drives the moveable member 680, allowing the utensil at the bottom of the stack (i.e. "the next utensil") to release from the pedestals 610, 620. Said another way, the ratchet 720 pushes the actuator 660 toward its dispense position, which pushes the drive mechanism 670 toward its ready position, which pulls the moveable member 680 toward its ready position. In this ready position for the moveable member 680, the engaging section 685 on the moveable member 680 receives at least a portion of the contoured projections 520 on the lower most or next utensil 20 at the bottom of the stack.

Figure 8:
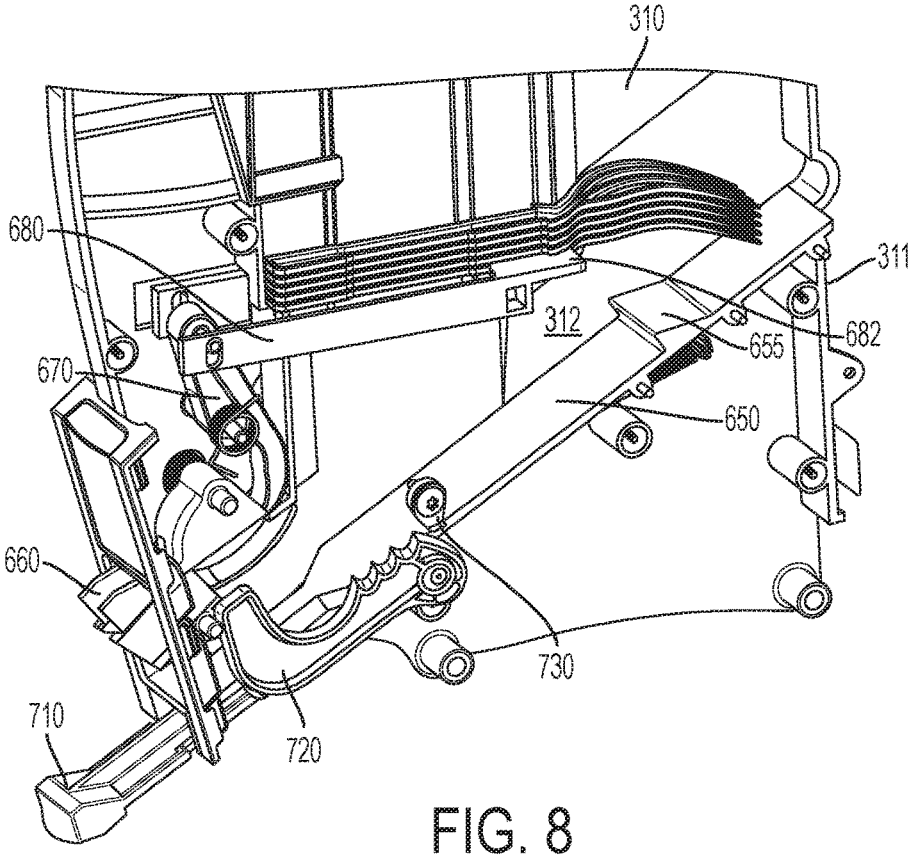
FIG. 8 depicts an enlarged cut away side view of the lower portion of the dispense chassis as the primer handle is fully extended from the dispense chassis, according to one or more embodiments provided herein.

FIG. 8 depicts an enlarged cut away side view of the lower portion of the chassis housing 310 as the primer handle 710 is fully extended, according to one or more embodiments. At this position of the priming movement, the ratchet 720 pushes against the actuator 660 toward its full rotated or open position (or dispense position), which drives the drive mechanism 670 to its ready position, which is a fully retracted or stop position. This fully retracted position helps prevent the spring 676 from winding unnecessarily to a full load, reducing the total amount of energy in the system.

Figure 9:
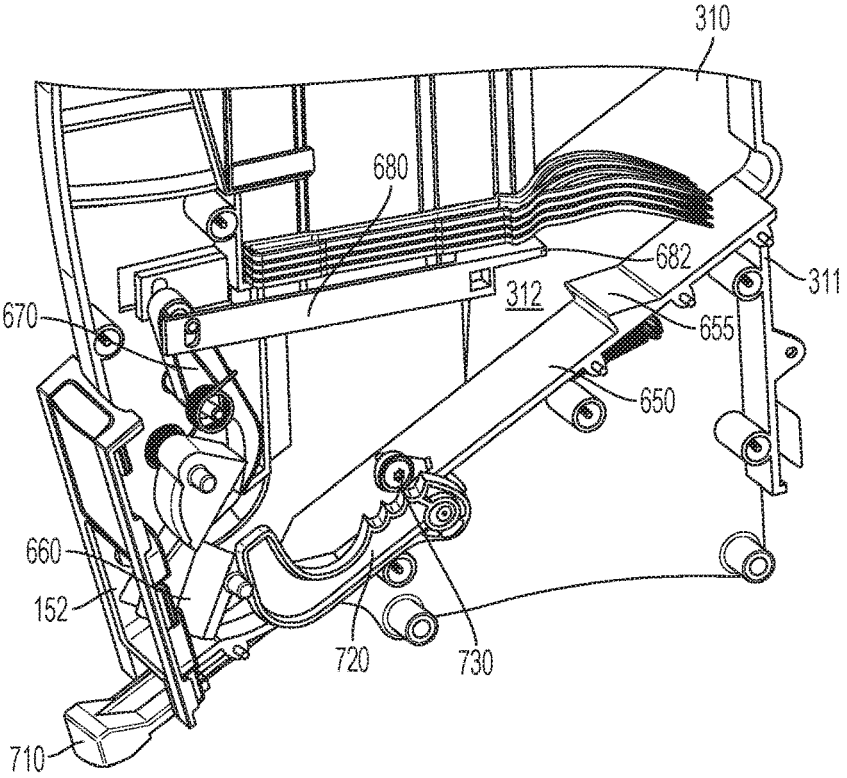
FIG. 9 depicts an enlarged cut away side view of the lower portion of the dispense chassis as the primer handle begins to return or retract into the dispense chassis, according to one or more embodiments provided herein.

FIG. 9 depicts an enlarged cut away side view of the lower portion of the dispense chassis as the primer handle 710 begins to return or retract back into the chassis housing 310, according to one or more embodiments. As the primer handle 710 returns to its resting or closed position, the moveable member 680 moves toward its dispense position. In its dispense position, the moveable member 680 has moved toward the backside 311 of the chassis housing 310 (opposite the access port 152) pushing the next utensil 20 away from the pedestals 610, 620.

Figure 10:
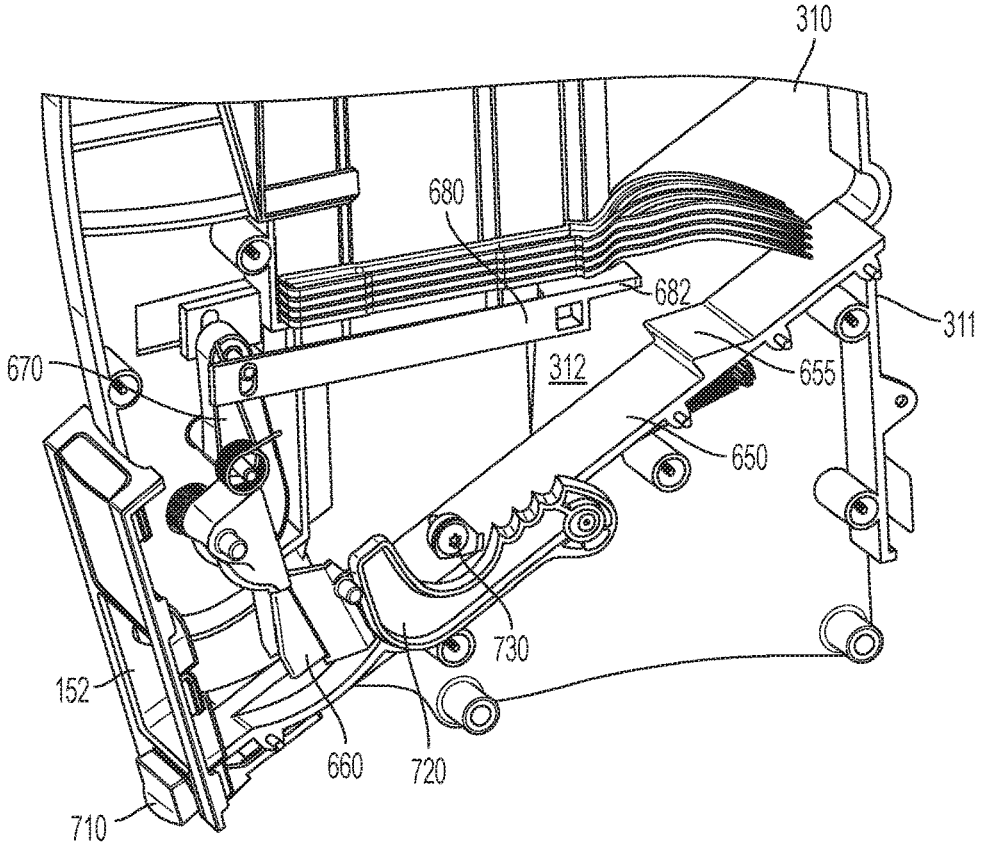
FIG. 10 depicts an enlarged cut away side view of the lower portion of the dispense chassis as the primer handle retracts into the dispense chassis, driving the push arm forward to release the next utensil from the stack, according to one or more embodiments provided herein.

FIG. 10 depicts an enlarged cut away side view of the lower portion of the chassis housing 310 as the primer handle 710 retracts into the chassis housing 310, according to one or more embodiments. In this position, the actuator 660 returns toward its closed or resting position, the drive mechanism 670 moves toward its release position and the moveable member moves toward its dispense position to push the next utensil away from the pedestals 610, 620 (best seen in FIG. 13). When cleared from the pedestals 610, 620, the next utensil releases from the stack and falls onto the gravity ramp 650, as shown in FIG. 11.

Figure 11:
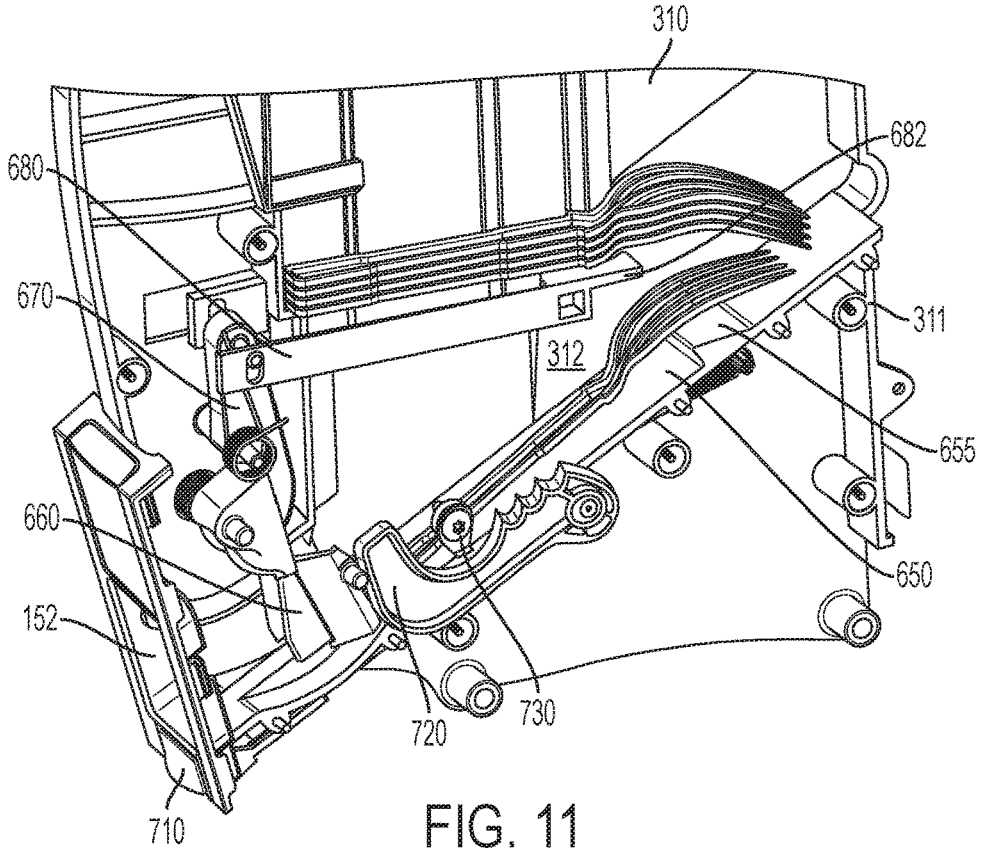
FIG. 11 depicts an enlarged cut away side view of the lower portion of the dispense chassis as the next utensil releases from the stack and falls onto a gravity ramp, according to one or more embodiments provided herein.

FIG. 11 depicts an enlarged cut away side view of the lower portion of the dispense chassis 150 as the next utensil releases from the stack and falls onto the gravity ramp 650, according to one or more embodiments. The released utensil can move down the gravity ramp 650 toward the access port 152 until it is caught and retained in the opening 665, as depicted in FIG. 12.

Figure 12:
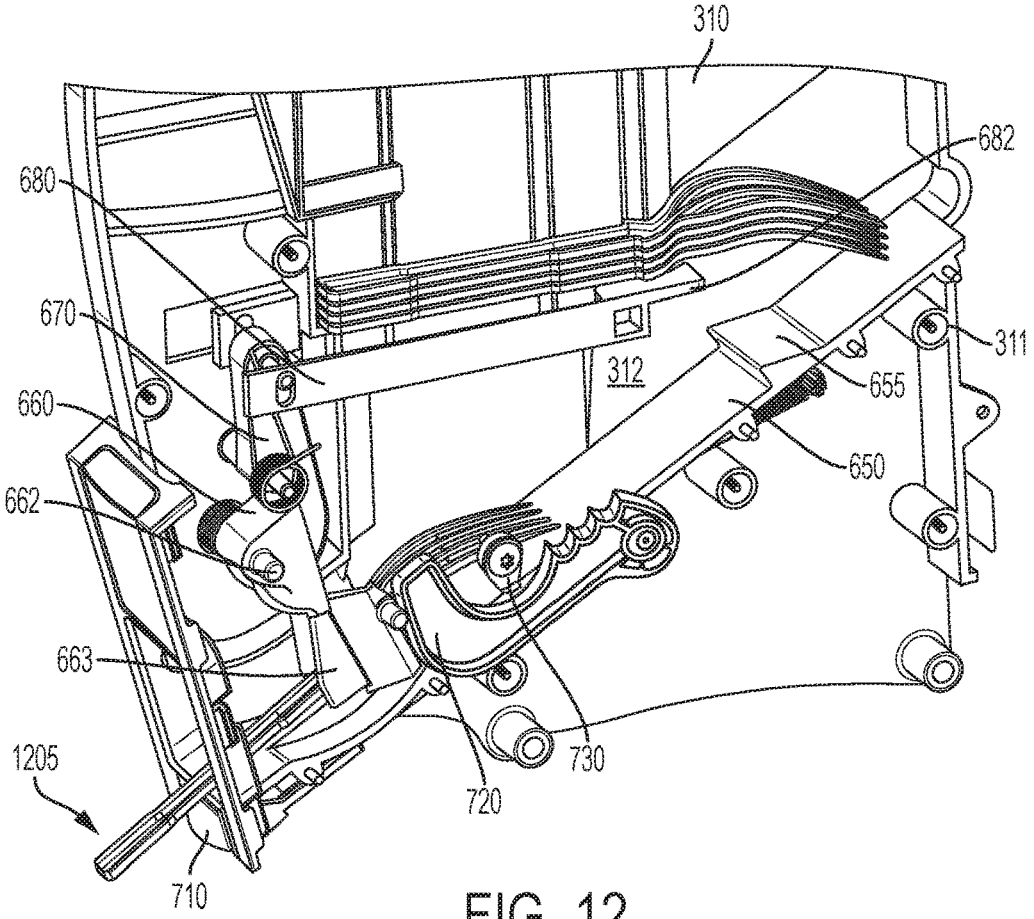
FIG. 12 depicts an enlarged cut away side view of the lower portion of the dispense chassis as the released utensil moves down a gravity ramp and is caught by an actuator and held in a dispensing position, according to one or more embodiments provided herein.
Figure 13:
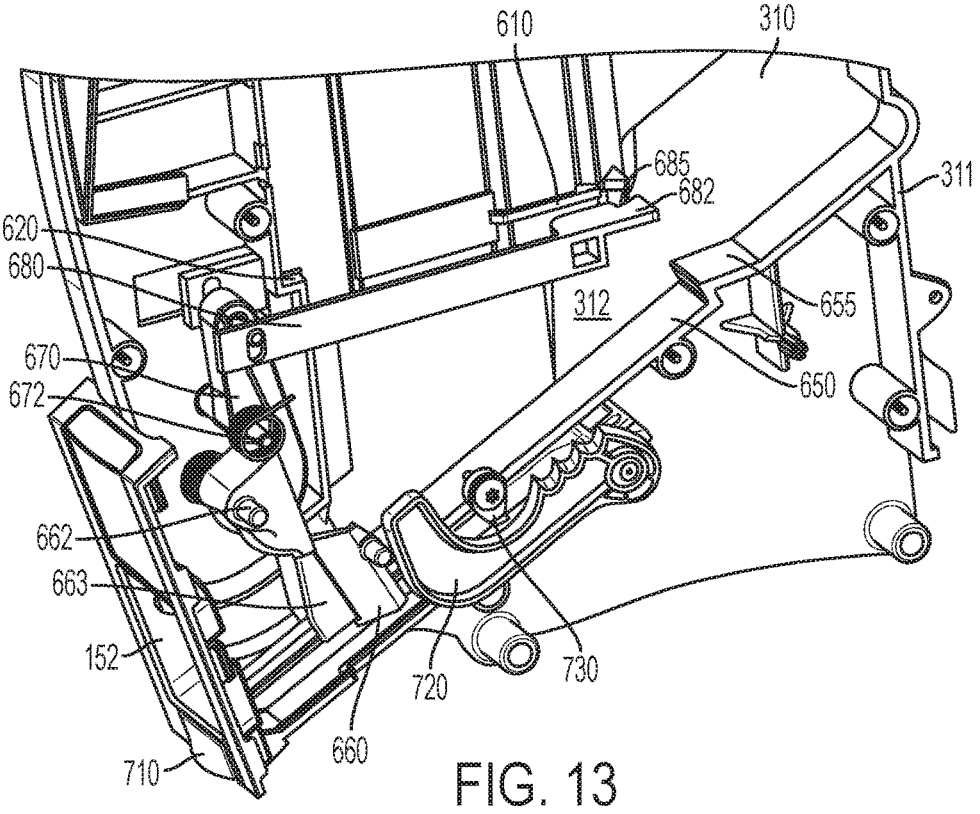
FIG. 13 is another view of FIG. 12 but with the utensils removed to better illustrate the moving parts of the dispense chassis.

FIG. 12 depicts an enlarged cut away side view of the lower portion of the dispense chassis 150 as the released utensil moves down the gravity ramp 650 and is caught by the actuator 660 and held in a dispensing position 1205, according to one or more embodiments. FIG. 13 is another view of FIG. 12 but with the utensils removed to better illustrate the moving parts of the dispense chassis 150. As depicted, the actuator 660, ratchet 720, drive mechanism 670 and moveable member 680 have all returned to the closed or ready position. It should be further detailed, that as the moveable member 680 returns to its retracted or ready position, extensions 682 can either move underneath the then next utensil of the stack or the extensions 682 can deflect outward, moving move around the contoured projections 525 of the then next utensil of the stack, until the contoured projections 525 fit within the engaging portion 685 of the extensions 682.

Referring again to FIGS. 7 to 13, the gravity ramp 650 can be angled or canted within the chassis housing 310. The gravity ramp 650 can slope from the back of the chassis housing 310 toward the front back of the chassis housing 310 (right to left in the views shown). The slope helps a released utensil slide on its own, via gravity, toward to the access port 152. The angle or slope gravity ramp 650 can range anywhere from a low of about 1, 5, or 10 degrees to a high of about 50, 60, or 80 degrees with relation to horizontal. As will be explained in more detail below, the angle or slant of the ramp 650 works with a swing trajectory of the actuator 660 to pinch or trap pieces of utensil therebetween thereby impeding the movement of utensils against the slope of the ramp 650 (i.e. up the ramp 650).

Optionally, the gravity ramp 650 can include at least one positioning mechanism 655 located on an upper surface thereof. The positioning mechanism 655 can be any suitable positioner, obstruction, stabilizer, bumper or guide, including but not limited to any one more steps, bumps, extensions or other artifices. Because of the positioning mechanism 655 being located on an upper surface of the gravity ramp 650, the upper surface of the gravity ramp 650 is not a flat or level surface. For example, the positioning mechanism 655 can be or include a stepped profile that is formed in, formed on, or otherwise located on the upper surface of the ramp 650. The positioning mechanism 655 can be integrally formed with the ramp 650 or can be a separate component attached, adhered, or otherwise affixed to the ramp 650. The positioning mechanism 655 provides a fulcrum or single point of contact that can be used to align or re-align a released utensil on the ramp 650. The positioning mechanism 655 can provide a point of contact to stabilize or re-direct a utensil as it lands on the gravity ramp 650. The positioning mechanism 655 can help a utensil land in a desired orientation after being released from the stack, e.g. lay flat opposed to lay on its side.

To further help a released utensil lay flat on the ramp 650, the inner wall 312 of the chassis housing 310 above the ramp 650 can be vertically sloped or canted. Still referring to FIGS. 7 to 13, one or both sides of the housing inner walls 312 above the ramp 650 can be sloped. For example, the canted portion 312 can angle anywhere from 3 to 40 degrees from vertical. For example, the canted portion 312 can slope upward from the ramp 650 at an angle from a low of about 3, 5, or 10 degrees to a high of about 15, 25, or 40 degrees. This sloped surface 312 helps prevent the released utensil from standing on its side by adding a moment to encourage the utensil to rotate and lay flat.

Figure 14:
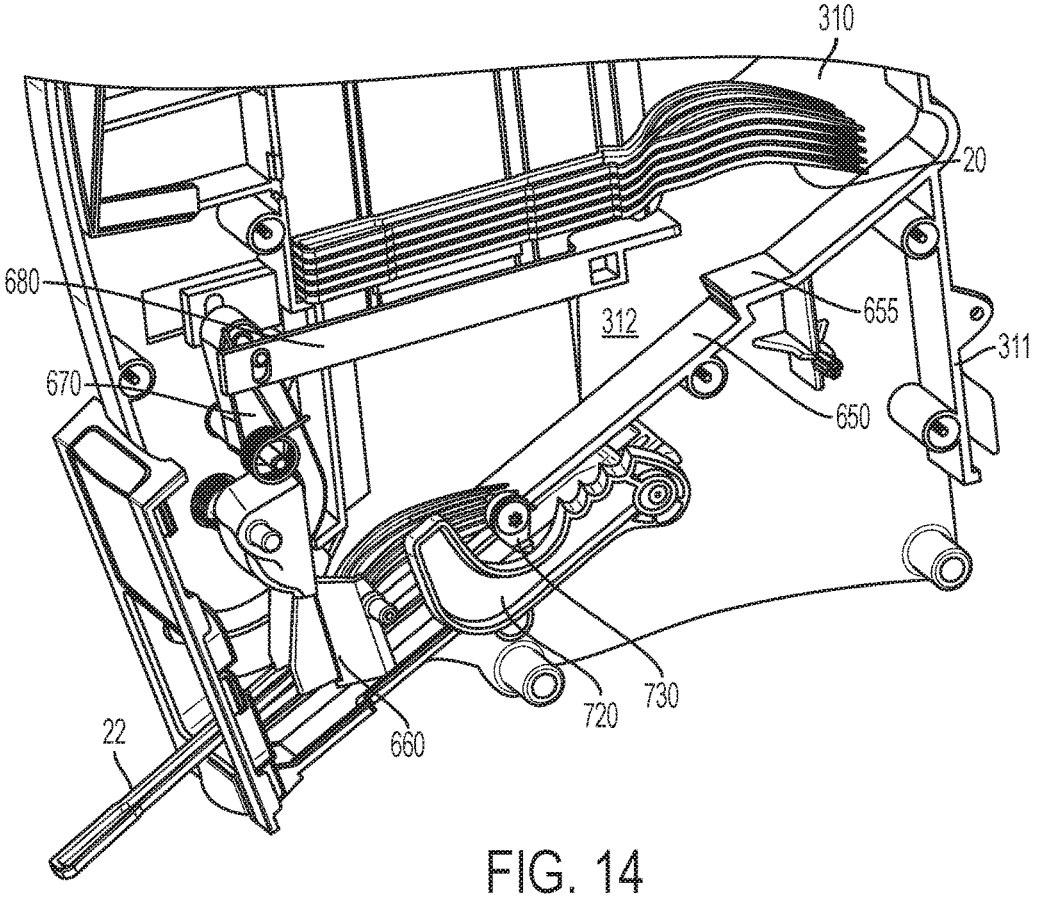
FIG. 14 depicts an enlarged cut away side view of the lower portion of the dispense chassis as the released utensil begins to be dispensed, according to one or more embodiments provided herein.
Figure 15:
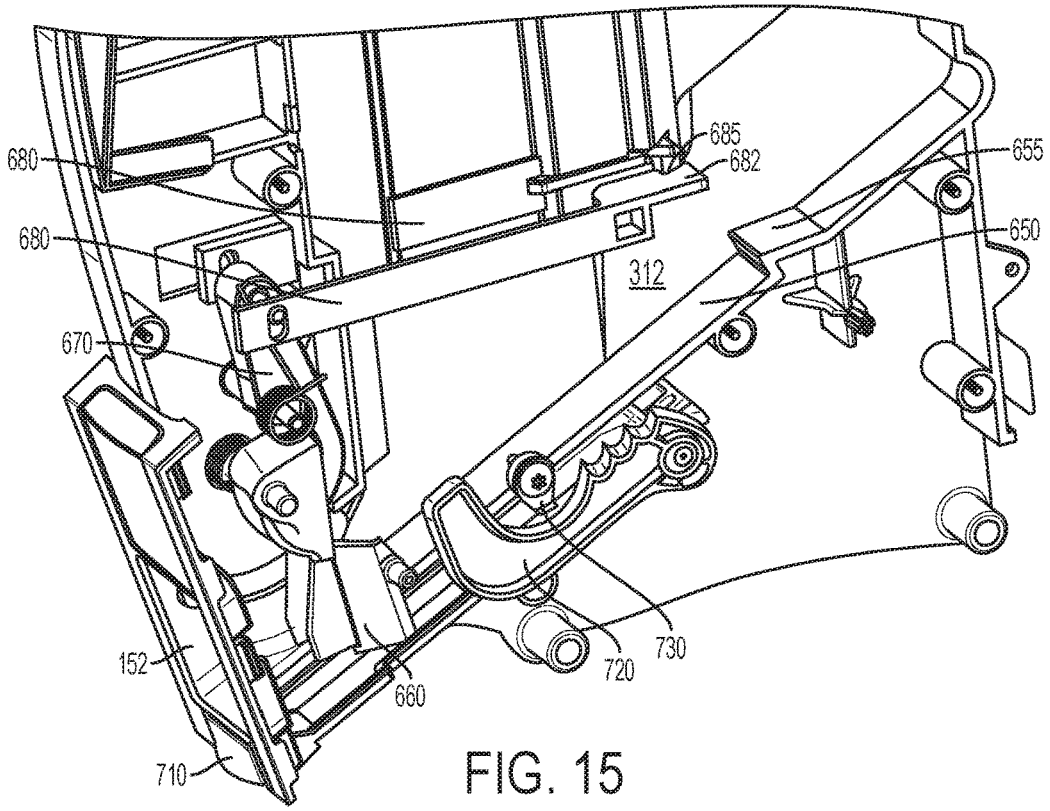
FIG. 15 is another view of FIG. 14 but with the utensils removed to better illustrate the moving parts of the dispense chassis.

Once primed, each dispense chassis 150 is ready for dispensing. FIGS. 14-21 provide time elapsed depictions of the dispensing process. FIG. 14 depicts an enlarged cut away side view of the lower portion of the dispense chassis as the released utensil 22 begins to be dispensed via the access port 152. FIG. 15 is another view of FIG. 14 but with the utensils removed to better illustrate the moving parts of the dispense chassis 150.

Figure 16:
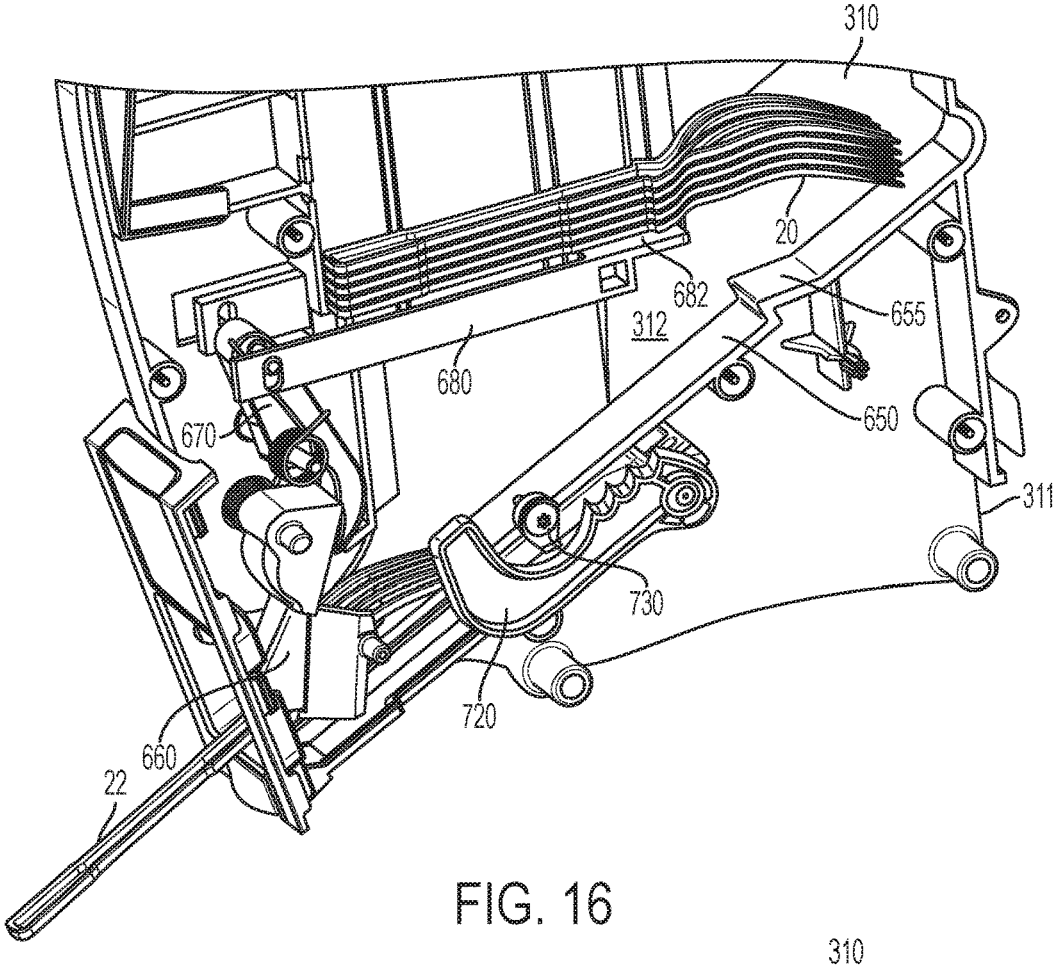
FIG. 16 depicts another enlarged cut away side view of the lower portion of the dispense chassis as the dispensing utensil drives the actuator backwards, according to one or more embodiments provided herein.
Figure 17:
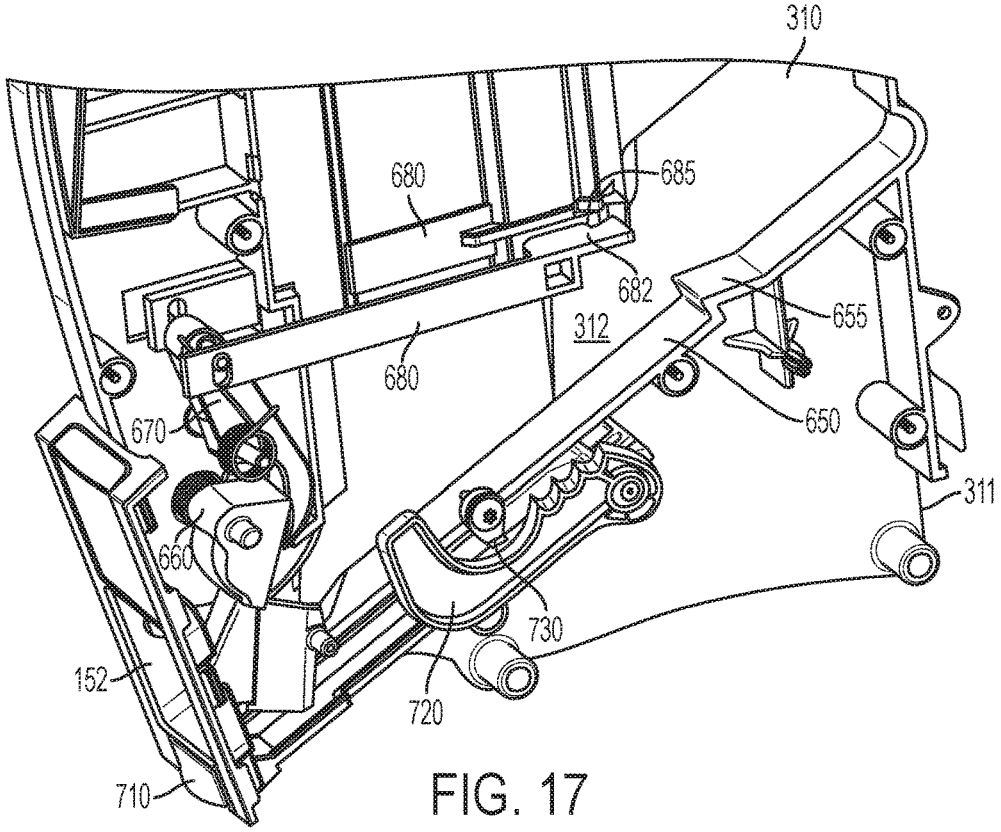
FIG. 17 is another view of FIG. 16 but with the utensils removed to better illustrate the moving parts of the dispense chassis.

FIG. 16 depicts another enlarged cut away side view of the lower portion of the dispense chassis as the dispensing utensil 22 drives the actuator 660 toward its dispense position, according to one or more embodiments. FIG. 17 is another view of FIG. 16 but with the utensils removed to better illustrate the moving parts of the dispense chassis. As depicted, movement of the actuator 660 causes movement of the drive mechanism 670, which causes the moveable member 680 to retract, allowing the engaging portion 685 of the extension 682 to move under or about the contoured projections 525 of the then next utensil 20.

Figure 18:
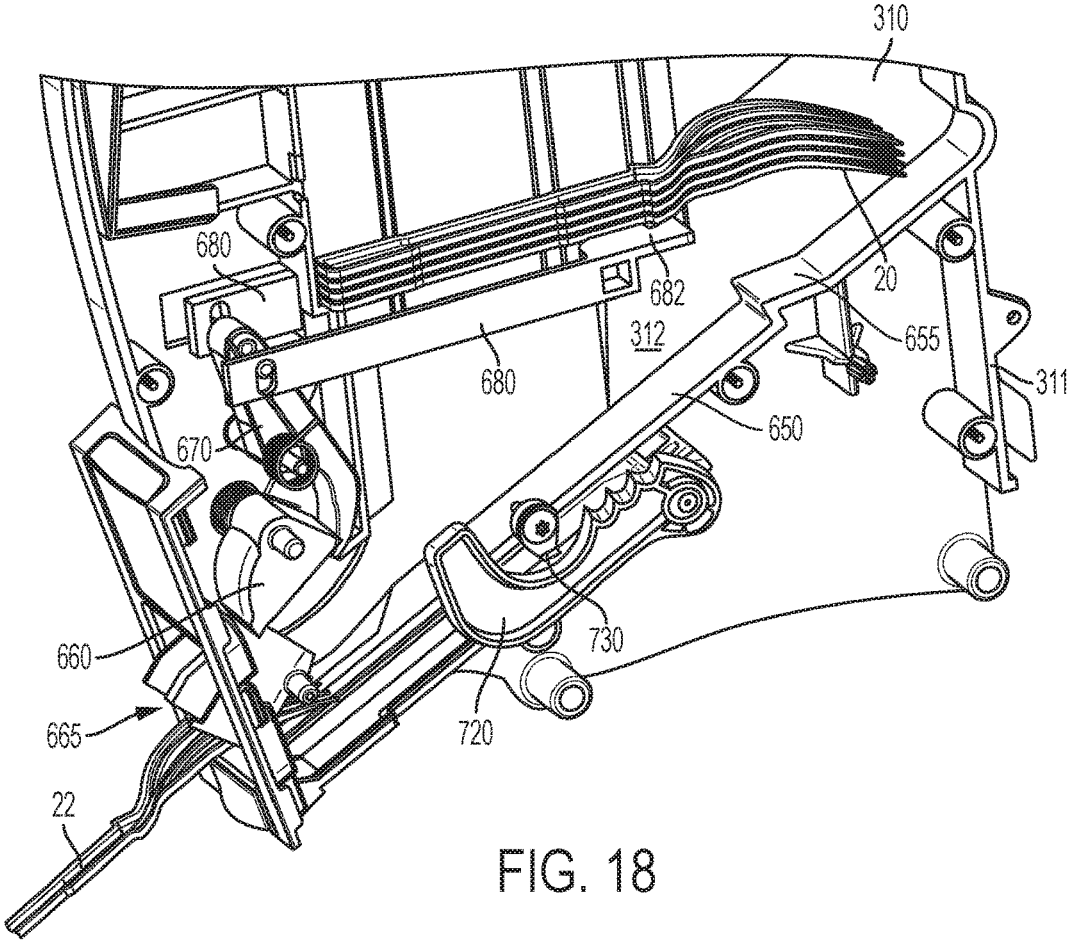
FIG. 18 depicts an enlarged cut away side view of the lower portion of the dispense chassis as the dispensing utensil exits the dispense chassis, triggering the release of the then next utensil from the stack, according to one or more embodiments provided herein.
Figure 19:
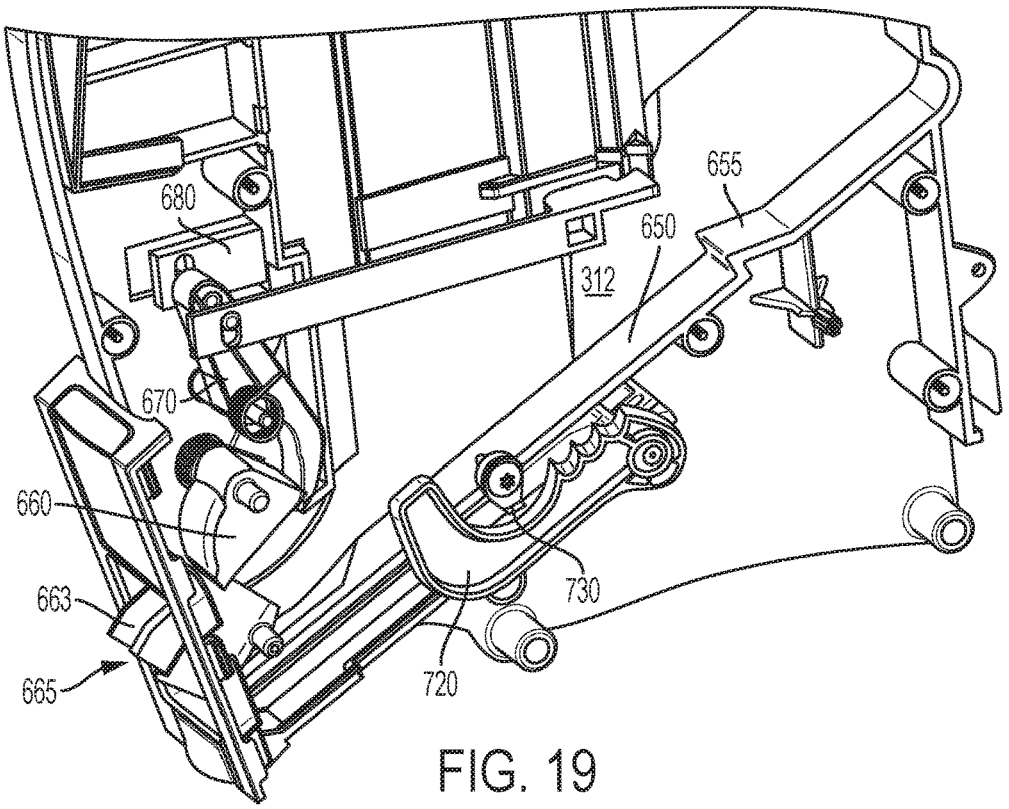
FIG. 19 is another view of FIG. 18 but with the utensils removed to better illustrate the moving parts of the dispense chassis.

FIG. 18 depicts an enlarged cut away side view of the lower portion of the chassis housing 310 as the dispensing utensil 22 exits the dispense chassis, triggering the release of the then next utensil 20 (i.e. lowermost utensil) from the stack, according to one or more embodiments. FIG. 19 is another view of FIG. 18 but with the utensils removed to better illustrate the moving parts of the dispense chassis. In this depiction, the utensil 22 is about freed from the dispense chassis 150, and the engaging portion 685 of the extension 682 of the moveable member 680 is clearing the front pedestal 610, triggering the release of the then next utensil 20 (i.e. lowermost utensil) from the stack.

Figure 20:
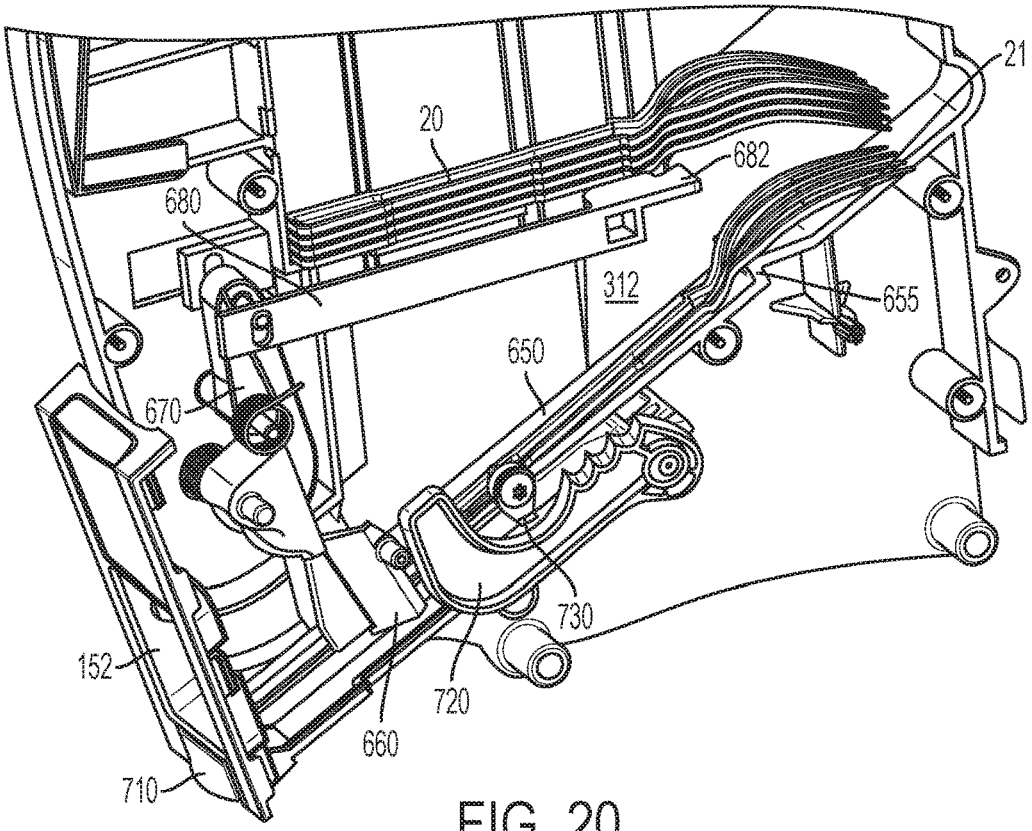
FIG. 20 depicts an enlarged cut away side view of the lower portion of the dispense chassis as the then next utensil lands on the gravity ramp and the actuator returns to its resting position, according to one or more embodiments provided herein.
Figure 21:
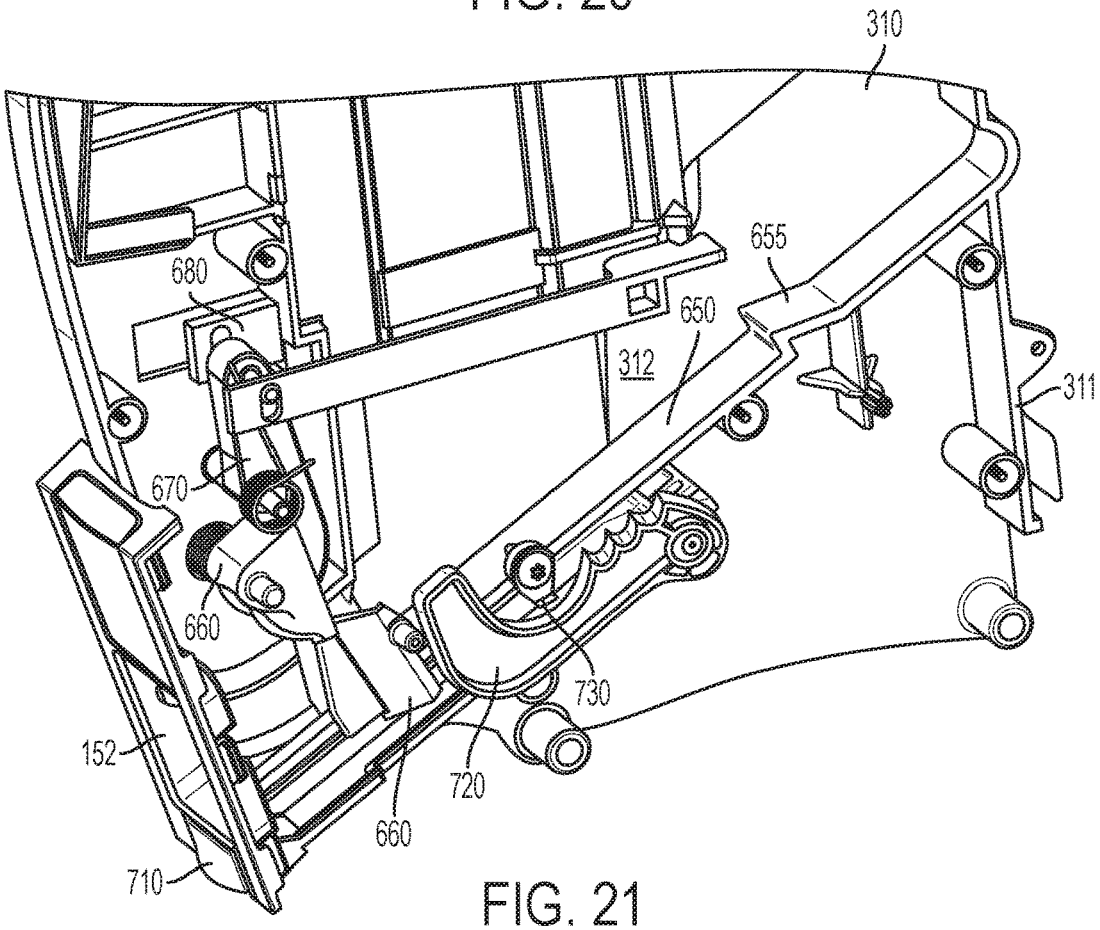
FIG. 21 is another view of FIG. 20 but with the utensils removed to better illustrate the moving parts of the dispense chassis.

FIG. 20 depicts an enlarged cut away side view of the lower portion of the dispense chassis as the then next utensil 20 releases from the stack. At this point of the cycle, the next utensil lands on the gravity ramp 650 and becomes the released utensil 21 lying on the ramp 650. FIG. 21 is another view of FIG. 20 but with the utensils removed to better illustrate the moving parts of the dispense chassis. The released utensil 21 can then move down the ramp 650 until caught in the opening 665 of the actuator 660. At this point, the handle end 50 of the released utensil 21 will extend through the access port 152 and be available for a next user to take, and a new next utensil 20 resides as the lowermost utensil in the stack. The process can then start over until all the utensils have been removed from the chamber 320 or interrupted to refill the dispense chassis 150.

Referring again to FIG. 12, the actuator 660 can include one or more arms or extensions 663 facing the access port 152. The arms or extensions 663 can be located proximate the opening 665 and extend from the actuator body toward the access port 152. The arms 663 are sized and shaped to exert a force on the one or more wings or detents 525 of the utensil passing through the opening 665. The arms or extensions 663 define a height or clearance zone between the upper surface of the ramp 650 and a lowest point on the actuator 660. This clearance zone is greatest when the actuator 660 moves toward the access port 152 toward its open or dispense position and is least when the actuator 660 moves away from the access port 152 toward its closed or resting position. As the actuator 660 moves toward its resting position, the arms 663 can exert a downward force on the detents 525 to pinch or otherwise trap the utensil against the ramp 650 within the clearance zone, preventing the utensil from moving back into the dispense chassis 150. Once the detents 525 on the utensil passes through the actuator 660 and clears the arms 663, the utensil is freed from the dispense chassis 150 and can be removed. In certain embodiments, the actuator 660 can include two arms 663 that are generally parallel to one another. By "generally parallel" it is meant that the arms 663 are mostly parallel to one another, accounting for any insignificant differences off of true parallel.

Figure 24:
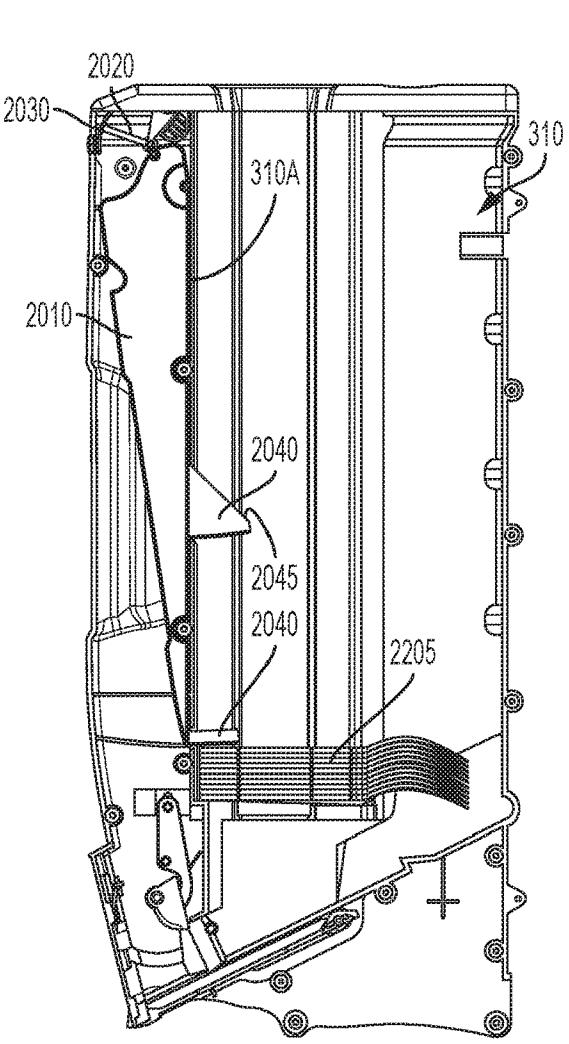
FIG. 24 depicts another illustrative cut away side view of the illustrative dispense chassis in which the dispense chassis is almost empty of utensils, according to one or more embodiments.
Figure 23:
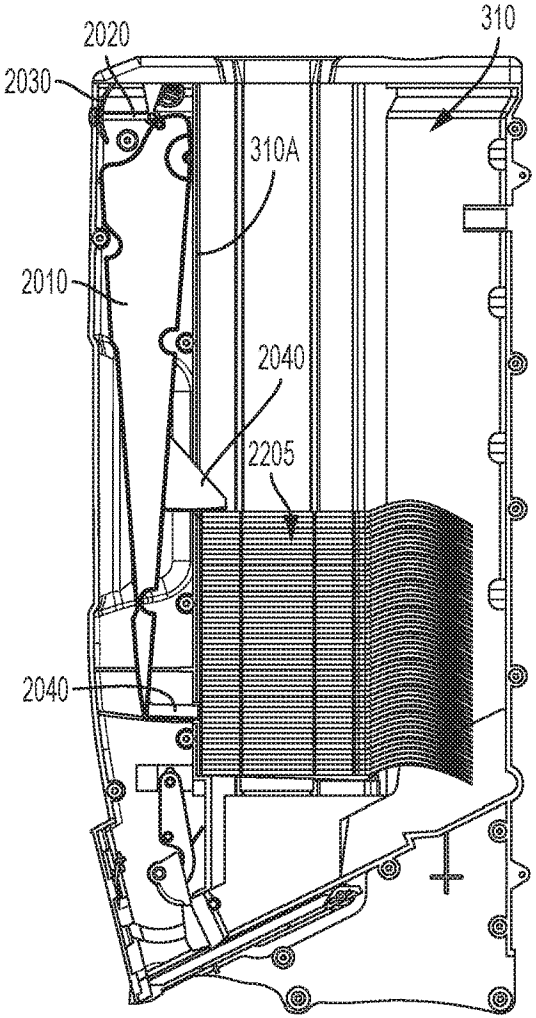
FIG. 23 depicts another illustrative cut away side view of the illustrative dispense chassis in which the dispense chassis is between half-full and empty of utensils, according to one or more embodiments.
Figure 22:
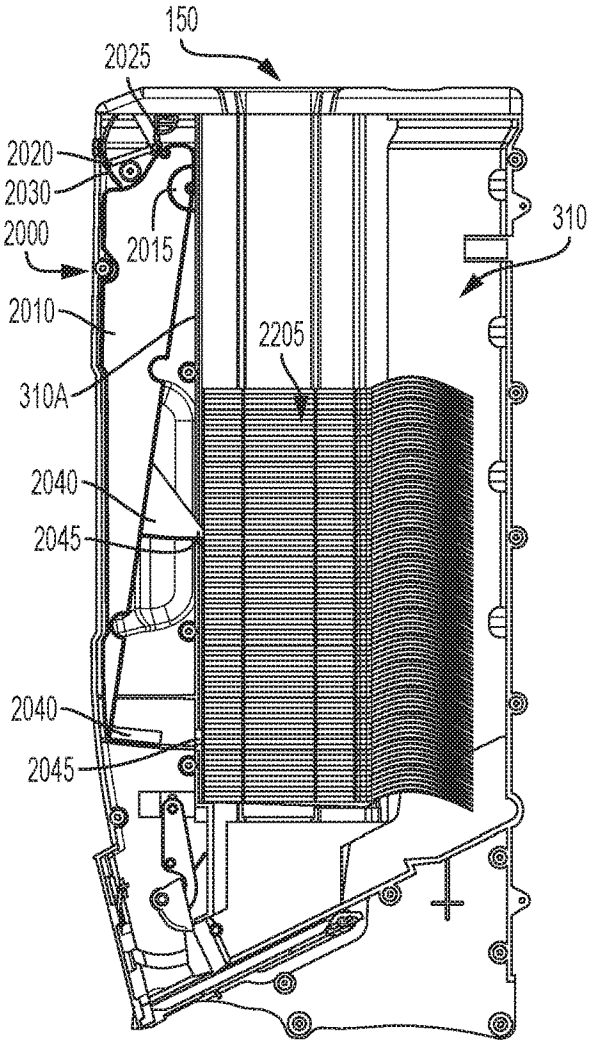
FIG. 22 depicts a cut away elevation view of the illustrative dispense chassis in which the chassis is generally full of utensils, according to one or more embodiments.

Each dispense chassis 150 can be configured with a gauging device to help approximate the number of utensils within the dispense chassis 150. FIGS. 22-24 provide illustrative cut away views of a dispense chassis 150 configured with a gauging assembly 2000, according to one or more embodiments. The gauging assembly 2000 can include a first gauge arm 2010 pivotally connected to the chassis housing 310 at pivot 2015, and a second gauge arm 2020 pivotally connected to the chassis housing 310 at pivot 2025. The second gauge arm 2020 can include an indicator 2030 at an external end thereof that can be seen through the apertures or windows 172 on the dispense chassis 150 and the apertures or windows 162 of the access door 130. The indicator 2030 provides a visual indication of the approximate number of utensils in the stack 2205.

Movement of the first gauge arm 2010 about its pivot connection 2012 can be translated to movement of the second gauge arm 2020 about its pivot connection 2025 to move the indicator 2030 relative to the gauge window 172. In an alternative embodiment that is not shown, the first gauge arm 2010 and the second gauge arm 2020 can be fixed together and can pivot such that movement of the first gauge arm 2010 about the pivot 2012 can be translated into movement of the second gauge arm 2020 to move the indicator 2030 relative to the gauge window 172.

The indicator 2030 can display different quantities of utensils within the stack 2205, the quantities being visible through the gauge window 172. The indicator 2030 can have different quantities printed on different parts of the indicator 2030. The different quantities can be visible through the gauge window 172 one at a time or multiple quantities can be displayed to show that the level is between the quantities displayed. For example, the indicator 2030 could have "Full" and/or a green color printed on the indicator 2030 that is visible through the gauge window 172 when the dispense chassis 150 has more than a certain amount of utensils in the utensil stack 2205, more than 50% full, more than 60% full, more than 70% full more than 80% full, or more than 90% full; "Half-Full" and/or a yellow color printed on the indicator portion that is visible through the gauge window 68 when the dispense chassis 150 has between certain amounts of utensils 20 in the utensil stack 2205, between 10% full and 90% full, between 20% full and 80% full, between 30% full and 70% full, between 40% full and 60% full; and/or "Empty" and/or a red color printed on the indicator 2030 that is visible through the gauge window 172 when the dispense chassis 150 has less than a certain amount of utensils, such as less than 5, less than 4, less than 3, less than 2, or none in the stack 2205. Alternatively, the colors can be used to indicate how many full stacks of utensils (the number of utensils in a full stack of utensil refills can vary) can be added to the dispense chassis 150. For example, where a full stack of utensil refills is thirty, green may indicate that less than one full stack of utensil refills will fit within the dispense chassis 150. Yellow can indicate that more than one full stack of utensil refills can be added to the dispense chassis 150, and red can indicate that two full stacks of utensil refills can be added to the dispense chassis 150.

The first gauge arm 2010 can include any number of extensions or prongs 2040 that are configured to contact a side of the stack 2205. For example, the first gauge arm 2020 can include 1 prong, 2 prongs, 3 prongs, 4 prongs, or 5 prongs disposed along its length. In one particular embodiment, the first gauge arm 2010 has two prongs as shown in FIGS. 22-24. The prongs 2040 can be disposed on any suitable position along the length of the first gauge arm 2010. If more than two prongs 2040 are used, the spacing between prongs 2040 can be the same or can vary. Although not shown, each prong 2040 can be moveably attached to the first gauge arm 2010 using a clamp or pinch like fastener, so that a prong 2040 can be moved or adjusted along the length of the first gauge arm 2010 based on patterns of use.

The chassis housing 310 can include a gauge aperture or opening 2045 formed through an internal wall 310A through which the prong(s) 2040 can extend and contact a side of the stack 2205. The gauge aperture or opening 2045 can be a recessed section or cut away formed in the internal wall 310A, allowing an adjacent prong 2040 to pass through. Referring to the embodiment shown in FIG. 22, when the height of the utensil stack 2205 is at or above the first or upper gauge opening 2045, the first or upper prong 2040 moves through the opening 2045 until it contacts the side of the stack 2205. This contact sets the first gauge arm 2010 at a first angle about its pivot 2015, which positions the second gauge arm 2020 at a first angle about its pivot 2025, which positions the indicator 2030 that is visible through the gauge window 172. The position of the indicator 2030 corresponds to a quantity of utensils in the stack 2205 (i.e. the height of the stack 2205) within the chassis housing 310.

FIG. 23 depicts the dispense chassis 150 having a stack 2205 half-full and empty of utensils. In this embodiment, the utensil stack 2205 is lower than the first, upper gauge opening 2045 and higher than the second, lower gauge opening 2045. The first, upper prong 2040 extends through its adjacent opening 2045 and the second, lower prong 2040 is blocked from extending through its adjacent opening 2045 by the stack 2205. Such positioning sets the first gauge arm 2010 at a second angle that is rotated relatively counterclockwise (as shown in FIG. 23) in comparison to the angle of the first gauge arm 2010 in FIG. 22. In this position, the second gauge arm 2020 is rotated about its pivot 2025, moving the indicator 2030 to show "Half-Full" or less than half-full through the gauge window 172.

FIG. 24 depicts the stack 2205 in the dispense chassis 150 almost empty. The utensil stack 2205 is lower than the lower, second gauge opening 2045 so that the upper and lower prongs 2040 can both extend through their respective openings 2045 in the inner wall 310A surrounding the stack 2205. This positions the first gauge arm 2010 at an angle more counterclockwise (as shown in FIG. 24) in comparison to the positions of the first gauge arm 2010 in FIGS. 22 and 23. This in turn, positions the second gauge arm 2020 at a different angle which positions the indicator 2030 to display "Empty" through the gauge window 172.

The gauge window 172 can have any suitable height, such as about 2 mm, 3 mm, 5 mm or more, and can display colors, numbers, percentages, or any other indicator to indicate the number of utensils or stack height within the dispense chassis 150. The first gauge arm 2010 can swing with gravity and with or without a spring assistance. The weight and/or the center of gravity of the first gauge arm 2010 can be adjusted to change how the utensil stack gauge 2000 operates. The position and/or the number of the prongs 2040 can be adjusted to provide more precise level indicators. Additionally, in an embodiment not shown, the first gauge arm 2010 can be located inside the housing wall 310A such that any one or more of the prongs 2040 can directly contact the utensil stack 2205 without passing through an opening 2045.

Figure 25:
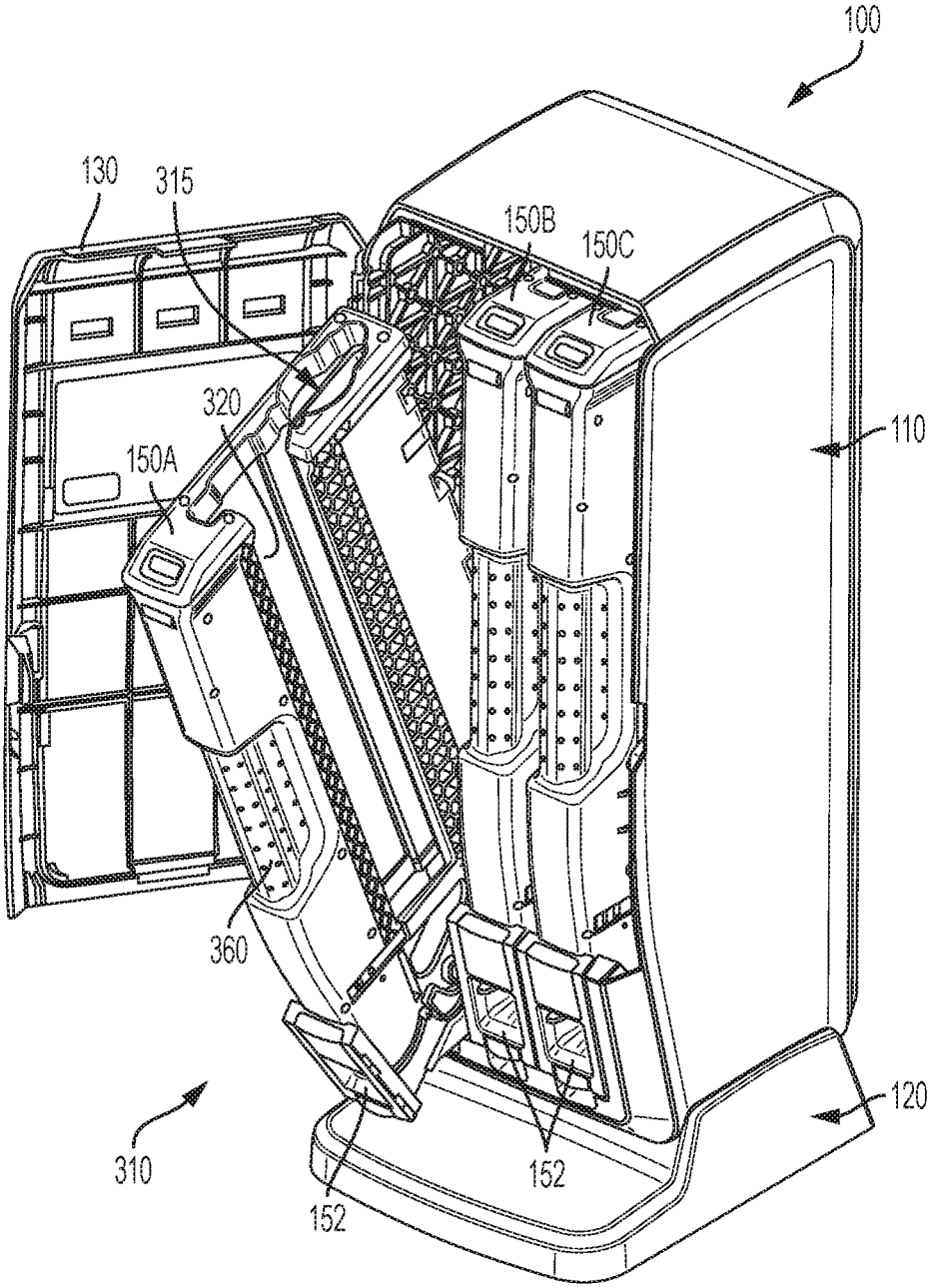
FIG. 25 depicts an illustrative perspective view of the utensil dispenser having its access door open, allowing a dispense chassis to be loaded, according to one or more embodiments provided herein.

FIG. 25 depicts a perspective view of the illustrative utensil dispenser 100 showing a first dispense chassis 150A in a loading position, and a second and third dispense chassis 150B, 150C in a dispensing position, according to one or more embodiments. When the dispense chassis 150A is in the loading position, utensils can be loaded into the first dispense chassis 150A through the loading opening 315. The same is true for the other dispense chassis 150B, 150C when time comes to re-load with utensils. Utensils in any dispense chassis that is in the dispensing position 330 can be dispensed while any one of the other dispense chassis is in a loading position. And as explained in more detail below, any dispense chassis 150 can be moved between a dispensing position and a loading position while remaining connected to the dispenser housing 110. Also as explained below in more detail, the dispenser housing 110 can include a mechanism to prevent the dispenser from toppling over while loading and re-loading the individual dispense chassis 150.

Figure 26:
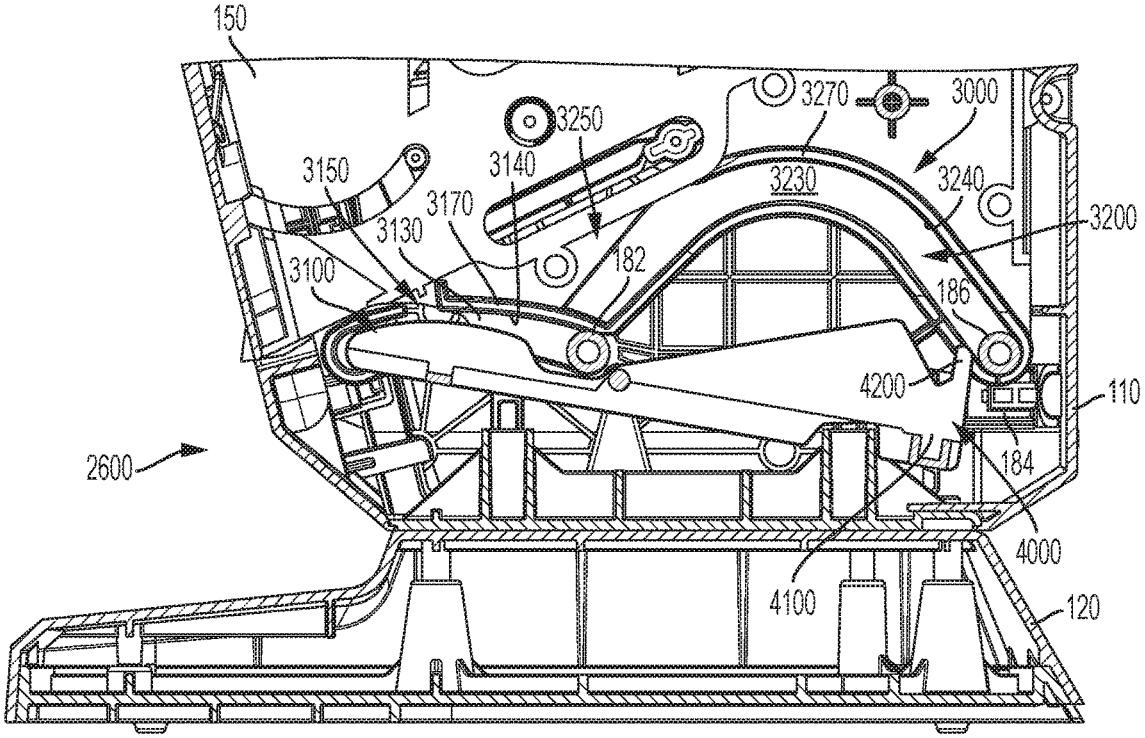
FIG. 26 depicts an illustrative cut away side views of the lower portion of the illustrative dispense chassis to better illustrate the dispense chassis in a dispensing position, according to one or more embodiments provided herein.
Figure 27:
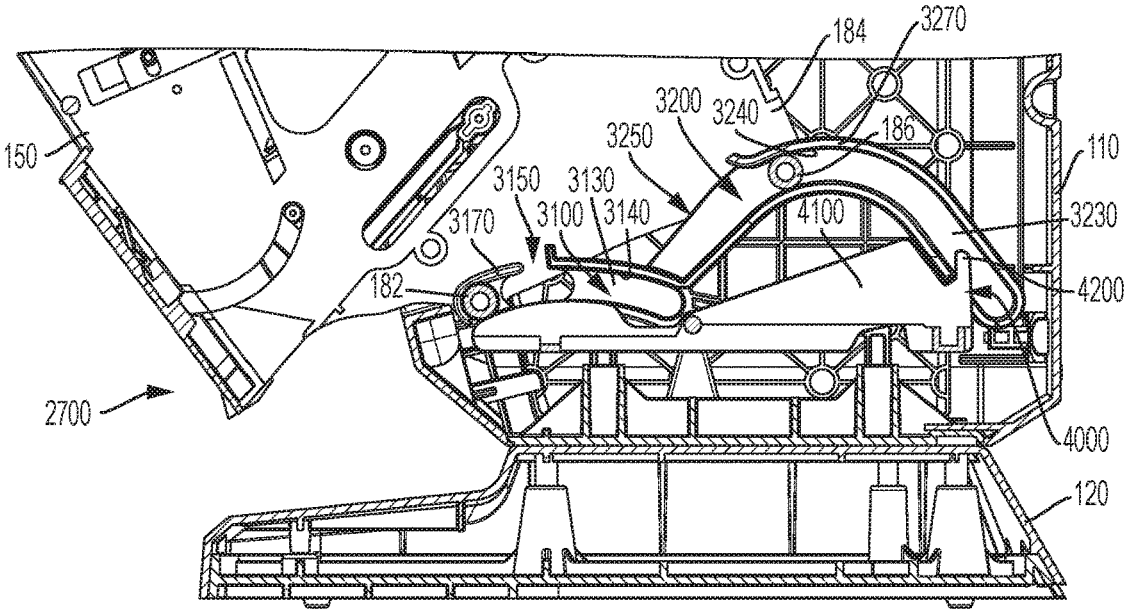
FIG. 27 depicts an illustrative cut away side views of the lower portion of the illustrative dispense chassis to better illustrate the dispense chassis in a loading position provided herein.

FIG. 26 depicts an illustrative cut away side views of the lower portion of the illustrative dispense chassis 150 to better illustrate the dispense chassis in a dispensing position 2600, and FIG. 27 depicts an illustrative cut away side views of the lower portion of the illustrative dispense chassis 150 to better illustrate the dispense chassis in a loading position 2700. Referring to FIGS. 26 and 27, the utensil dispenser 100 can include a dispense chassis support or glide mechanism 3000 which can be connected to the base 120 of the dispenser housing 110 for supporting at least one utensil dispense chassis 150.

The glide mechanism 3000 can include one or more slots or channels (two are shown 3100, 3200) for guiding each dispense chassis 150. Each slot 3100, 3200 can resemble a guide rail or opening and can be configured to retain a prong or pin appended to a lower portion of each dispense chassis 150. Each slot 3100, 3200 can be curvilinear to allow a dispense chassis to pivot or tilt outward, away from the back of the dispenser housing 110. The slope and degree of curvature can be determined based on the size and weight of the dispense chassis 150. Likewise, the spacing between the slots 3100, 3200 can be determined based on the height of the dispense chassis 150 and the needed clearance from the dispenser housing 110. The glide mechanism 3000 can support the dispense chassis 150 in a dispensing position 2600 (FIG. 26) and in the loading position 2700 (FIG. 27) without having to remove the dispense chassis 150 being loaded from the dispenser. The glide mechanism 3000 also provides support and guidance to more easily move a dispense chassis 150 between its dispensing position 2600 and its loading position 2700. The glide mechanism 3000 serves as a controlled pivot point for each chassis 150.

To utilize the glide mechanism 3000, each dispense chassis 150 can include a first pin 182 and a second pin 184 that are connected to or integral a lower portion 184 of the dispense chassis 150. The first pin 182 and/or second pin 186 are configured to fit and move within the first and second slots 3100 and 3200 of the glide mechanism 3000. The first pin 182 and/or second pin 186 can be any rounded cylindrical or tubular shaped structures. The first pin 182 and/or second pin 186 can be fixed or stationary. The first pin 182 and/or second pin 186 can also be rollers that can roll within their respective slots 3100, 3200.

Figure 28:
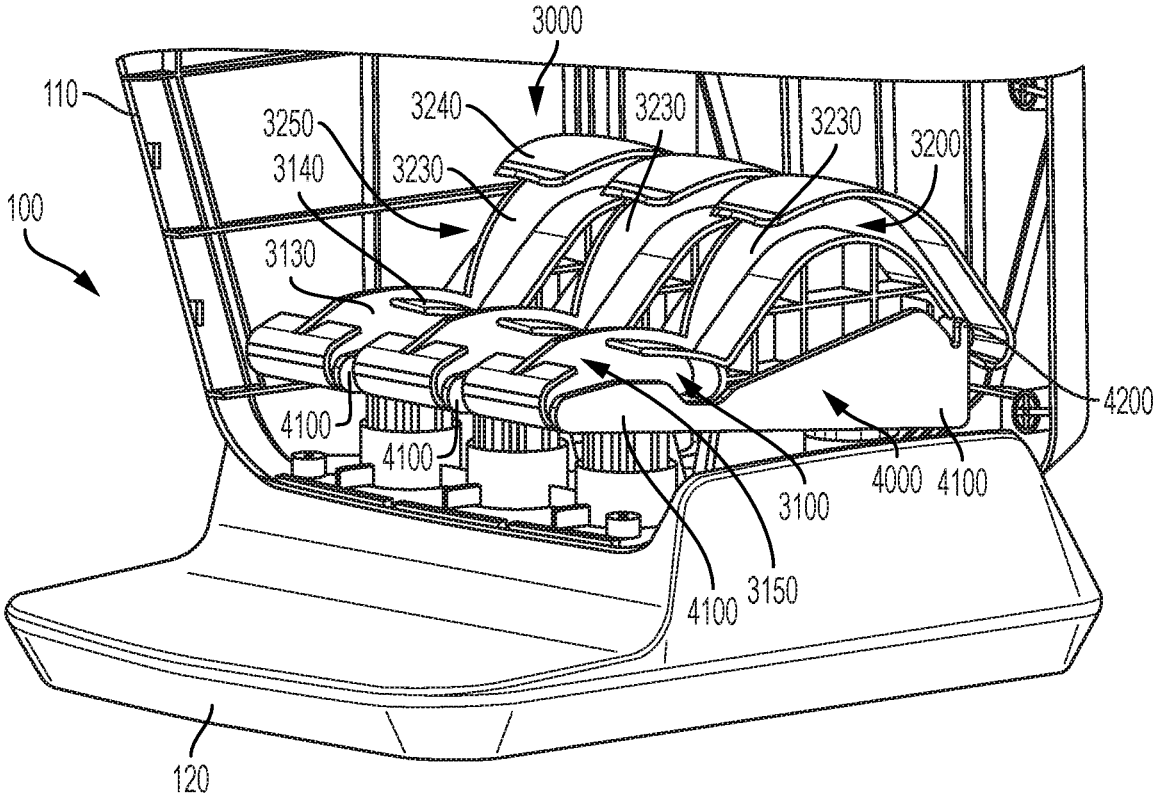
FIG. 28 depicts an illustrative cut away perspective view of the lower portion of the dispenser housing, according to one or more embodiments.

In a particular configuration, the first slot 3100 can include an arcuate shape and can guide the first pin 182 in a forward and upward motion as the dispense chassis 150 is moved from the dispensing position 2600 to the loading position 2700. The second slot 3200 can also have an arcuate shape and can guide the second pin 186 in an arcuate and forward motion. Each slot 3100, 3200 can include one or more sidewalls 3130, 3230 to provide a rail like containment (FIG. 28). Each slot 3100, 3200 can also include a covering or upper wall 3140, 3240 to further contain the pins 184, 186 of the dispense chassis 150. Each slot 3100, 3200 can further include an upper opening to allow the dispense chassis 150 to be removed from the dispenser housing 110. For example, the first slot 3100 can have a first slot opening 3150 through which the first pin 182 can escape the first slot 3100 when removing the dispense chassis 150 from the glide mechanism 3000. Likewise, the second slot 3200 can include a second slot opening 3250 through which the second pin 186 can escape the second slot 3200 when removing the dispense chassis 150 from the glide mechanism 3000.

The pins 182 and 186 and/or the slots openings 3150, 3250 can be spaced such that only one of the pins 182 and 186 can be removed through its respective slot openings 3150, 3250 at a time. The pins 182 and 186 and/or the slots openings 3150, 3250 can also be spaced such that the second slot opening 3250 can be positioned such that the second pin 186 cannot be removed from the second slot 3200 unless the first pin 182 is first removed from its slot 3100. Either or both of these configurations help prevent the dispense chassis 150 from inadvertently falling out of the dispenser housing 110 when moving between the dispensing position 2600 and the loading position 2700.

The first slot 3100 can include a first end and a second end and a crown 3170 therebetween which is relatively higher than the ends. The first pin 182 can be located at the first end of the first slot 3100 when the dispense chassis 150 is in the dispensing position 2600 (FIG. 26) and can be located at the second end of the first slot 3100 when the dispense chassis 150 is in the loading position 2700 (FIG. 27). The crown 3170 can bias the first pin 182 toward the first end or the second end depending on which side of the crown 3170 the first pin 182 is located.

The second slot 3200 also includes a first end and a second end with a crown 3270 therebetween. The second pin 186 of the dispense chassis 150 can be located at the first end of the second slot 3200 when the dispense chassis 150 is in the dispensing position 2600 (FIG. 2600) and can be located at the second end when the dispense chassis 150 is in the loading position 2700 (FIG. 27). The crown 3270 can bias the second pin 186 toward the first end of the slot 3200 when the second pin 186 is on a first side of the crown 3270 and can bias the second pin 186 toward the second end of the slot 3200 when the second pin 186 is on a second side of the crown 3270. The ends of each slot 3100, 3200 provide a stop for the dispense chassis 150 and prevent further movement from the dispensing position 174 and the loading position 172.

Still referring to FIGS. 26 and 27, the utensil dispenser 100 can further include a chassis interlock assembly 4000 to help prevent the utensil dispenser 100 from tipping forward due to having too much weight in front of the base 120. Each glide mechanism 3000 can be configured with the chassis interlock assembly 4000. The chassis interlock 4000 can include at least one body or arm 4100 having a contoured lower surface that is configured to rock on top of the base 120. The chassis interlock 4000 can also be mechanically joined to one or more of the glide mechanisms 3000 to rock together as a single unit.

Each arm 4100 is configured with an upwardly extending post or lock 4200 that is configured to enter into the second slot 3200 of the glide mechanism 3000, preventing the second pin 186 of every chassis 150 in the dispenser at the time from moving past. When one of the dispense chassis 150 is moved to the loading position 2700 (FIG. 27), the chassis interlock 4000 tilts forward with the dispense chassis 150, lifting the post 4200 into the back slot 3200, which locks the other dispense chassis 150 in the dispensing position 2600. This is a convenience and a safety feature to keep the utensil dispenser 100 from tipping forward due to having too much weight in front of the base 120.

When all the dispense chassis 150 in the dispenser housing 110 of the utensil dispenser 100 are in the dispensing position 2600 (FIG. 26), the dispense chassis interlock assembly 4000 can be in an unlocked position (FIG. 26), and any one of the dispense chassis 150 can be moved to the loading position 2700 (FIG. 27). In the unlocked position, a first portion of the interlock arm 4100 can be relatively upward (left side in FIGS. 26-28) and the second portion of the interlock arm 4100 can be relatively lower (right side of arm 4100 in FIGS. 26-28). In the unlocked position, the interlock arm 4100 does not interfere with the movement of any of the dispense chassis 150. When one of the dispense chassis 150 is moved to the loading position 2700 (FIG. 27), however, the dispense chassis interlock 4000 moves to its locked position (FIG. 27) where the post 4200 enters the back slot 3200 and prevents the other dispense chassis 150 from moving forward. In the locked position, the first portion of the interlock arm 4100 toggles downward and the second portion moves up, causing the post 4200 to interfere with the movement of the second pin 186 of the remaining dispense chassis 150. Movement of the dispense chassis 150 back to the dispensing position 2600 returns the dispense chassis interlock 4000 to the unlocked position (FIG. 26).

Embodiments of the present disclosure further relate to any one or more of the following paragraphs 1 to 55:

1. A utensil dispenser configured to dispense at least two utensils, comprising: a housing configured to contain a stack of the utensils therein; an access port providing an opening to the housing; a drive mechanism configured to contact and release a utensil from the lowermost position of the stack; and an inclined surface located beneath the stack of utensils, the inclined surface comprising a positioning mechanism formed thereon.

2. The utensil dispenser according to paragraph 1, wherein the positioning mechanism is a bump.

3. The utensil dispenser according to paragraph 1 or 2, wherein the positioning mechanism is a stepped profile.

4. The utensil dispenser according to any one or more paragraphs 1 to 3, wherein the positioning mechanism is formed integrally with the inclined surface or appended thereto.

5. The utensil dispenser according to any one or more paragraphs 1 to 4, wherein the inclined surface slopes toward the access port.

6. The utensil dispenser according to any one or more paragraphs 1 to 5, wherein the inclined surface slopes toward the access port at an angle ranging from a low of about 1, 5, or 10 degrees to a high of about 50, 60, or 80 degrees.

7. The utensil dispenser according to any one or more paragraphs 1 to 6, further comprising an actuator that is operably connected to the drive mechanism, the actuator configured to move the drive mechanism between a ready position and dispense position.

8. The utensil dispenser according to paragraph 7, further comprising a prime mechanism configured to move the actuator and the drive mechanism, the prime mechanism comprising a primer handle mechanically linked to a ratchet having one or more teeth for engaging a pawl that is disposed on an inner wall of the housing.

9. The utensil dispenser according to paragraph 8, wherein the actuator comprises outwardly extending posts configured to engage the ratchet, thereby moving the actuator as the primer handle is extended from the housing.

10. The utensil dispenser according to any one or more paragraphs 7 to 9, wherein the actuator is disposed above a lower end of the inclined surface.

11. A utensil dispenser configured to dispense at least two utensils, comprising: a housing configured to contain a stack of the utensils therein; an access port providing an opening to the housing; a drive mechanism configured to contact and release a utensil from the lowermost position of the stack; an inclined surface located beneath the stack of utensils; and an actuator that is operably connected to the drive mechanism, the actuator configured to move the drive mechanism between a ready position and dispense position, wherein the actuator comprises: a body that is pivotably mounted to the housing, an opening formed through a lower portion of the body, and at least one arm located proximate the opening and extending from the body toward the access port.

12. The utensil dispenser according to paragraph 11, wherein the at least one arm comprises two generally parallel arms extending from the body toward the access port.

13. The utensil dispenser according to paragraphs 11 or 12, wherein the at least one arm is configured to exert a downward force on a utensil disposed on the inclined surface, preventing the utensil from moving back into the housing.

14. The utensil dispenser according to any one or more paragraphs 11 to 13, wherein the actuator comprises a contoured surface for engaging a mating contoured surface on the drive mechanism.

15. The utensil dispenser according to paragraph 14, wherein the contoured surfaces are cam surfaces.

16. The utensil dispenser according to any one or more paragraphs 11 to 15, wherein the inclined surface slopes toward the access port.

17. The utensil dispenser according to any one or more paragraphs 11 to 16, wherein the inclined surface slopes toward the access port at an angle ranging from a low of about 1, 5, or 10 degrees to a high of about 50, 60, or 80 degrees.

18. The utensil dispenser according to any one or more paragraphs 11 to 17, further comprising a prime mechanism configured to move the actuator and the drive mechanism, the prime mechanism comprising a primer handle mechanically linked to a ratchet having one or more teeth for engaging a pawl that is disposed on an inner wall of the housing.

19. The utensil dispenser according to paragraph 18, wherein the actuator further comprises outwardly extending posts configured to engage the ratchet, thereby moving the actuator as the primer handle is extended from the housing.

20. The utensil dispenser according to paragraphs 18 or 19, wherein the actuator is disposed above a lower end of the inclined surface.

21. A utensil dispenser configured to dispense at least two utensils, comprising: a housing configured to contain a stack of the utensils therein, wherein the stack of the utensils comprises at least one utensil in addition to a next utensil; an access port providing an opening to the housing; a drive mechanism configured to contact the next utensil; an actuator that is operably connected to the drive mechanism and configured to move the drive mechanism where the drive mechanism pushes the next utensil in the stack causing the next utensil to release from the stack of the utensils; and a prime mechanism configured to move the actuator and the drive mechanism between a ready position and a dispense position, the prime mechanism comprising a primer handle mechanically linked to a ratchet having one or more teeth for engaging a pawl that is disposed on an inner wall of the housing.

22. The utensil dispenser according to paragraph 21, wherein the prime mechanism is configured to move between an extended position and a rest position, whereby the drive mechanism is moved to its ready position when the prime mechanism is moved to the extended position and the drive mechanism is moved to its dispense position when the prime mechanism is moved to the rest position.

23. The utensil dispenser according to paragraphs 21 or 22, further comprising a return spring configured to bias the prime mechanism toward the rest position.

24. The utensil dispenser according to any one or more paragraphs 21 to 23, wherein the prime mechanism is configured to actuate the drive mechanism when the primer handle is pulled away from the housing.

25. The utensil dispenser according to any one or more paragraphs 21 to 24, wherein the ratchet is operatively connected to the actuator to move the actuator thereby moving the drive mechanism.

26. The utensil dispenser according to any one or more paragraphs 21 to 25, wherein the actuator comprises outwardly extending posts configured to engage the ratchet, thereby moving the actuator as the primer handle and ratchet are extended from the housing.

27. The utensil dispenser according to any one or more paragraphs 21 to 26, wherein the primer handle is accessible outside the housing and configured to slide away from the access port, whereby movement of the primer handle drives the actuator and initiates the release of the next utensil from the stack.

28. The utensil dispenser according to any one or more paragraphs 21 to 27, wherein the ratchet comprises a push surface adapted to engage one or more outwardly extending posts appended to the actuator.

29. The utensil dispenser according to any one or more paragraphs 21 to 28, wherein the ratchet comprises a dwell surface located between the push surface and the teeth, the dwell surface allows the pawl to reset as the primer handle returns into the housing.

30. The utensil dispenser according to any one or more paragraphs 21 to 29, wherein the prime mechanism comprises two ratchets, one opposite the other, whereby the utensil is able to pass between the ratchets.

31. A utensil dispenser configured to dispense at least two utensils, comprising: a housing configured to contain a stack of the utensils therein, wherein the stack of the utensils comprises at least one utensil in addition to a next utensil and each utensil comprises at least one contoured projection extending outwardly therefrom; a front pedestal disposed inside the housing, the front pedestal configured to support at least one of the at least one contoured projections extending outwardly from the next utensil; and a moveable member disposed within the housing, the moveable member having an engaging section capable of engaging the contoured projection extending outwardly from the next utensil, the moveable member configured to move from a ready position to a dispense position.

32. The dispenser according to paragraph 31, further comprising a rear pedestal disposed inside the housing, the rear pedestal configured to support one end of the next utensil.

33. The dispenser according to paragraphs 31 or 32, wherein the moveable member is substantially parallel with the next utensil.

34. The dispenser according to any one or more paragraphs 31 to 33, wherein the contoured projection on each utensil has a tapered outer surface.

35. The dispenser according to any one or more paragraphs 31 to 34, wherein the contoured projection fits within the engaging section of the moveable member.

36. The dispenser according to any one or more paragraphs 31 to 35, wherein the moveable member is configured to move about the contoured projection, allowing the contoured projection of the next utensil to at least partially reside within the engaging section of the moveable bar.

37. The dispenser according to paragraph 36, wherein the moveable member comprises at least one extension arm and the engaging section of the moveable member is disposed on at least one of the at least one extension arms, the at least one extension arm configured to flex outwardly when sliding about the contoured projection.

38. The dispenser according to any one or more paragraphs 31 to 37, wherein the moveable member comprises at least one extension arm and the engaging section of the moveable member is disposed on at least one of the at least one extension arms, the engaging section configured to move beneath the contoured projection.

39. The dispenser according to any one or more paragraphs 31 to 38, wherein the moveable member comprises at least one extension arm and the engaging section of the moveable member is disposed on at least one of the at least one extension arms, the engaging section configured to move above the contoured projection.

40. A utensil dispenser configured to dispense at least two utensils, comprising: a housing configured to contain a stack of the utensils therein, wherein the stack of the utensils comprises at least one utensil in addition to a next utensil and each utensil comprises at least one contoured projection extending outwardly therefrom; a front pedestal disposed inside the housing, the front pedestal configured to support the at least one contoured projection extending outwardly from the next utensil; and a moveable member disposed within the housing and configured to move from a ready position to a dispense position, the moveable member comprising at least one extension arm configured with at least one engaging section, wherein the engaging section is capable of receiving the contoured projection extending outwardly from the next utensil.

41. The dispenser according to paragraph 40, wherein the engaging section of the moveable member comprises a slot, notch or area of reduced wall thickness in the extension arm.

42. The dispenser according to paragraphs 40 or 41, wherein the moveable member comprise two extension arms situated to flank opposing longitudinal sides of the next utensil.

43. The dispenser according to any one or more paragraphs 40 to 42, wherein the engaging section of the moveable member is configured to move relative to the contoured projection, allowing the contoured projection of the next utensil to at least partially reside within the engaging section of the moveable bar.

44. The dispenser according to any one or more paragraphs 40 to 43, wherein the extension arm of the moveable member is configured to flex outwardly as the engaging section of the moveable member move about the contoured projection.

45. The dispenser according to any one or more paragraphs 40 to 44, wherein the engaging section of the moveable member is configured to move beneath the contoured projection.

46. The dispenser according to any one or more paragraphs 40 to 45, wherein the engaging section of the moveable member is configured to move above the contoured projection.

47. A utensil dispenser configured to dispense at least two utensils, comprising: a housing configured to contain a stack of the utensils therein, wherein the stack of the utensils comprises at least one utensil in addition to a next utensil and each utensil comprises at least one contoured projection extending outwardly therefrom; a front pedestal disposed inside the housing, the front pedestal configured to support the at least one contoured projection extending outwardly from the next utensil; a rear pedestal disposed inside the housing, the rear pedestal configured to support a handle end of the next utensil; a dispensing mechanism disposed within the housing, the dispensing mechanism comprising at least two engaging surfaces configured to move back and forth; a moveable member disposed within the housing and configured to move from a ready position to a dispense position due to the back and forth movement of the dispensing mechanism, the moveable member having at least one extension arm extending away from the rear pedestal and configured with at least one engaging section proximate a distal end thereof, wherein the engaging section is capable of receiving at least a portion of the contoured projection extending outwardly from the next utensil.

48. The dispenser according to paragraph 47, wherein the extension arm of the moveable member is configured to flex outwardly as the engaging section of the moveable member moves about the contoured projection.

49. The dispenser according to paragraphs 47 or 48, wherein the engaging section of the moveable member is configured to move beneath the contoured projection.

50. The dispenser according to any one or more paragraphs 47 to 49, wherein the engaging section of the moveable member is configured to move above the contoured projection.

51. A method for dispensing one or more utensils from a dispenser, comprising: pulling a handle end of a utensil extending from a housing configured to contain a stack of utensils therein, each utensil comprising at least one contoured projection extending outwardly therefrom and supported on a front pedestal disposed inside the housing; triggering a movement of a first portion of a dispensing mechanism to move an extension member within the housing, the extension member having an engaging section capable of receiving the contoured projection extending outwardly from a utensil located at a bottom of the stack, wherein generally linear movement of the extension member releases the utensil from the bottom of the stack; and retaining the released utensil within the housing using a second portion of the dispensing mechanism, the second portion located beneath the first portion and comprising an opening to allow the handle end of the released utensil to pass through and extend outside the housing.

52. The method according to paragraph 51, wherein the engaging section of the extension member is configured to flex outwardly as the extension member moves about the contoured projection.

53. The method according to paragraphs 51 or 52, wherein the engaging section of the extension member is configured to move beneath the contoured projection.

54. The method according to any one or more paragraphs 51 to 53, wherein the engaging section of the extension member is configured to move above the contoured projection.

55. The method according to any one or more paragraphs 51 to 54, wherein the moveable member comprise two extension arms configured to flank opposing longitudinal sides of the utensil located at the bottom of the stack.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A utensil dispenser configured to dispense at least two utensils, comprising:

a housing configured to contain a stack of the utensils therein, wherein the stack of the utensils comprises at least one utensil in addition to a next utensil and each utensil comprises at least one contoured projection extending outwardly therefrom;

a front pedestal disposed inside the housing, the front pedestal configured to support the stack of utensils; and a moveable member disposed within the housing, the moveable member having an engaging section capable of engaging at least one of the contoured projection extending outwardly from the next utensil while the front pedestal supports the stack of utensils, the moveable member configured to move from a ready position to a dispense position.

2. The dispenser of claim 1, wherein the front pedestal is configured to support at least one of the at least one contoured projections extending outwardly from the next utensil.

3. The dispenser of claim 1, wherein the moveable member comprises at least one extension arm and the engaging section of the moveable member is disposed on at least one of the at least one extension arms, the engaging section configured to move above the contoured projection.

4. The dispenser of claim 1, wherein the moveable member comprises at least one extension arm and the engaging section of the moveable member is disposed on at least one of the at least one extension arms, the engaging section configured to move beneath the contoured projection.

5. The dispenser of claim 1, further comprising a rear pedestal disposed inside the housing, the rear pedestal configured to support one end of the next utensil.

6. The dispenser of claim 1, wherein the moveable member is substantially parallel with the next utensil.

7. The dispenser of claim 1, wherein the contoured projection on each utensil has a tapered outer surface.

8. The dispenser of claim 1, wherein the contoured projection fits within the engaging section of the moveable member.

9. The dispenser of claim 1, wherein the moveable member is configured to move about the contoured projection, allowing the contoured projection of the next utensil to at least partially reside within the engaging section of the moveable member.

10. The dispenser of claim 9, wherein the moveable member comprises at least one extension arm and the engaging section of the moveable member is disposed on at least one of the at least one extension arms, the at least one extension arm configured to flex outwardly when sliding about the contoured projection.

11. A utensil dispenser configured to dispense at least two utensils, comprising:

a housing configured to contain a stack of the utensils therein, wherein the stack of the utensils comprises at least one utensil in addition to a next utensil and each utensil comprises at least one contoured projection extending outwardly therefrom;

a front pedestal disposed inside the housing, the front pedestal configured to support the at least one contoured projection extending outwardly from the next utensil; and a moveable member disposed within the housing and configured to move from a ready position to a dispense position, the moveable member comprising at least one extension arm configured with at least one engaging section that is capable of receiving the contoured projection extending outwardly from the next utensil while the front pedestal supports the at least one contoured projection extending outwardly from the next utensil.

12. The dispenser of claim 11, wherein the engaging section of the moveable member comprises a slot, notch or area of reduced wall thickness in the extension arm.

13. The dispenser of claim 11, wherein the moveable member comprise two extension arms situated to flank opposing longitudinal sides of the next utensil.

14. The dispenser of claim 11, wherein the engaging section of the moveable member is configured to move relative to the contoured projection, allowing the contoured projection of the next utensil to at least partially reside within the engaging section of the moveable member.

15. The dispenser of claim 14, wherein the extension arm of the moveable member is configured to flex outwardly as the engaging section of the moveable member move about the contoured projection.

16. The dispenser of claim 14, wherein the engaging section of the moveable member is configured to move beneath the contoured projection.

17. The dispenser of claim 14, wherein the engaging section of the moveable member is configured to move above the contoured projection.

18. A utensil dispenser configured to dispense at least two utensils, comprising:

a housing configured to contain a stack of the utensils therein, wherein the stack of the utensils comprises at least one utensil in addition to a next utensil and each utensil comprises at least one contoured projection extending outwardly therefrom;

a front pedestal disposed inside the housing, the front pedestal configured to support the at least one contoured projection extending outwardly from the next utensil;

a rear pedestal disposed inside the housing, the rear pedestal configured to support a handle end of the next utensil;

a dispensing mechanism disposed within the housing, the dispensing mechanism comprising at least two engaging surfaces configured to move back and forth;

a moveable member disposed within the housing and configured to move from a ready position to a dispense position due to the back and forth movement of the dispensing mechanism, the moveable member having at least one extension arm extending away from the rear pedestal and configured with at least one engaging section proximate a distal end thereof, wherein the engaging section is capable of receiving at least a portion of the contoured projection extending outwardly from the next utensil while the front pedestal supports the at least one contoured projection extending outwardly from the next utensil.

19. The dispenser of claim 18, wherein the extension arm of the moveable member is configured to flex outwardly as the engaging section of the moveable member moves about the contoured projection.

20. The dispenser of claim 18, wherein the engaging section of the moveable member is configured to move beneath the contoured projection.

21. The dispenser of claim 18, wherein the engaging section of the moveable member is configured to move above the contoured projection.

22. A method for dispensing one or more utensils from a dispenser, comprising:

pulling a handle end of a utensil extending from a housing configured to contain a stack of utensils therein, each utensil comprising at least one contoured projection extending outwardly therefrom and supported on a front pedestal disposed inside the housing;

triggering a movement of a first portion of a dispensing mechanism to move an extension member within the housing, the extension member having an engaging section capable of receiving the contoured projection extending outwardly from a utensil while located at a bottom of the stack, wherein generally linear movement of the extension member releases the utensil from the bottom of the stack; and retaining the released utensil within the housing using a second portion of the dispensing mechanism, the second portion located beneath the first portion and comprising an opening to allow the handle end of the released utensil to pass through and extend outside the housing.

23. The method of claim 22, wherein the engaging section of the extension member is configured to flex outwardly as the extension member moves about the contoured projection.

24. The method of claim 22, wherein the engaging section of the extension member is configured to move beneath the contoured projection.

25. The method of claim 22, wherein the engaging section of the extension member is configured to move above the contoured projection.

26. The method of claim 22, wherein the extension member comprises two extension arms configured to flank opposing longitudinal sides of the utensil located at the bottom of the stack.

* * * * *